US007267419B2

(12) United States Patent
Yamasaki

(10) Patent No.: US 7,267,419 B2
(45) Date of Patent: Sep. 11, 2007

(54) METHOD FOR LIQUID EJECTION AND LIQUID EJECTING APPARATUS

(75) Inventor: Keigo Yamasaki, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 279 days.

(21) Appl. No.: 10/932,346

(22) Filed: Sep. 2, 2004

(65) Prior Publication Data

US 2005/0052487 A1 Mar. 10, 2005

(30) Foreign Application Priority Data

Sep. 3, 2003 (JP) ..... 2003-311459
Sep. 3, 2003 (JP) ..... 2003-311460

(51) Int. Cl.
*B41J 29/393* (2006.01)
*B41J 25/308* (2006.01)
*B41J 29/38* (2006.01)
*B41J 2/01* (2006.01)

(52) U.S. Cl. ..... 347/19; 347/8; 347/16; 347/104

(58) Field of Classification Search ..... 347/19
See application file for complete search history.

(56) References Cited

U.S. PATENT DOCUMENTS 6,464,319 B1 * 10/2002 Teshigawara et al. ..... 347/19
6,471,315 B1 * 10/2002 Kurata ..... 347/8
6,557,961 B2 * 5/2003 Cheng et al. ..... 347/9
6,623,093 B2 * 9/2003 Takahashi et al. ..... 347/16
6,755,499 B2 * 6/2004 Castano et al. ..... 347/19
6,883,892 B2 * 4/2005 Sievert et al. ..... 347/19
7,052,100 B2 * 5/2006 Otsuki ..... 347/16

FOREIGN PATENT DOCUMENTS

JP 2001-038963 A 2/2001

* cited by examiner

*Primary Examiner*—Matthew Luu
*Assistant Examiner*—Shelby Fidler
(74) *Attorney, Agent, or Firm*—Sughrue Mion, PLLC

(57) ABSTRACT

A method for liquid ejection includes the steps of: moving nozzles, which eject a liquid, in a movement direction; supporting a medium with a plurality of supporting sections that are arranged at different positions in the movement direction; and forming a plurality of patterns for adjusting a liquid ejection timing by ejecting the liquid from the nozzles onto the medium supported by the supporting sections; wherein a group of patterns, from among the plurality of patterns, that are formed in the movement direction is a group of patterns for coarse adjustment; and wherein a group of patterns, from among the plurality of patterns, that are formed in a direction that intersects the movement direction is a group of patterns for fine adjustment.

16 Claims, 19 Drawing Sheets

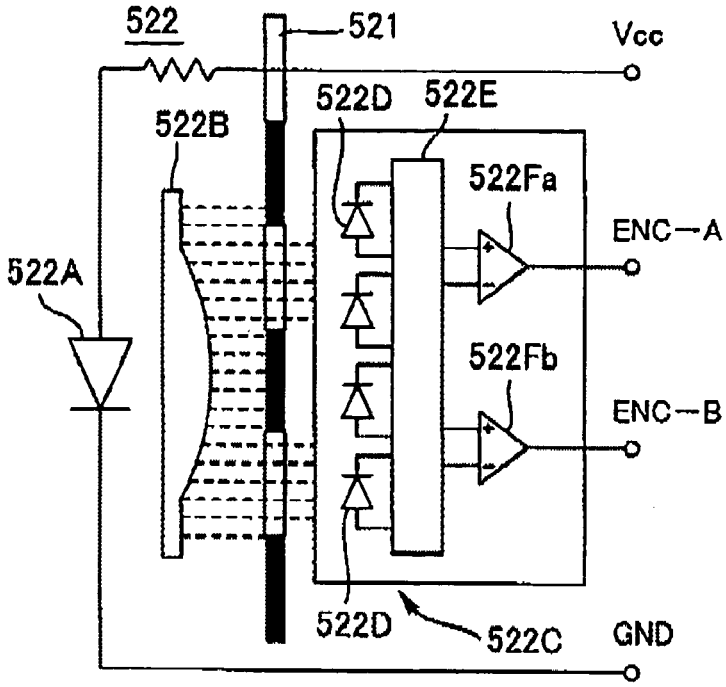
FIG. 8
FIG. 9A
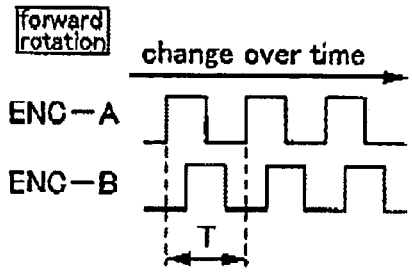
FIG. 9B
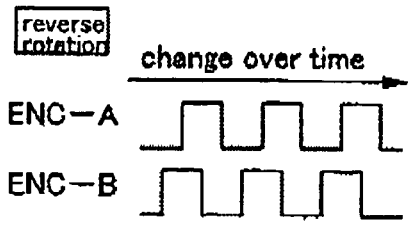

(forward pass pattern)

(return pass pattern)

(optimum pattern)

(adjustment pattern in which return pass pattern is shifted to the right)

(adjustment pattern in which return pass pattern is shifted to the left)

METHOD FOR LIQUID EJECTION AND LIQUID EJECTING APPARATUS

CROSS-REFERENCE TO RELATED APPLICATIONS

The present application claims priority upon Japanese Patent Application No. 2003-311459 filed on Sep. 3, 2003 and Japanese Patent Application No. 2003-311460 filed on Sep. 3, 2003, which are herein incorporated by reference.

BACKGROUND OF THE INVENTION

1. Field of the Invention

The present invention relates to methods for liquid ejection and liquid ejecting apparatuses.

2. Description of the Related Art

Liquid ejecting apparatuses (such as printers) that are provided with a moving member, which moves liquid ejection sections (such as nozzles) in a movement direction, and a plurality of supporting sections that are arranged at different positions in the movement direction are known in the art. With this type of configuration, a medium that is supported by the supporting sections becomes wave-shaped. Thus, the amount of shift in the landing position of a liquid (such as ink) that is ejected from the nozzles differs depending on its position in the movement direction.

In a liquid ejecting apparatus of such a configuration, there is a possibility that an appropriate adjustment value cannot be obtained when an adjustment pattern is formed by ejecting liquid from the liquid ejection sections onto the medium.

SUMMARY OF THE INVENTION

It is an object of the present invention to form an adjustment pattern on deformed paper.

According to a first aspect of the present invention, a method for liquid ejection comprises the steps of:

moving nozzles, which eject a liquid, in a movement direction;

supporting a medium with a plurality of supporting sections that are arranged at different positions in the movement direction; and forming a plurality of patterns for adjusting a liquid ejection timing by ejecting the liquid from the nozzles onto the medium supported by the supporting sections;

wherein a group of patterns, from among the plurality of patterns, that are formed in the movement direction is a group of patterns for coarse adjustment; and wherein a group of patterns, from among the plurality of patterns, that are formed in a direction that intersects the movement direction is a group of patterns for fine adjustment.

According to a second aspect of the present invention, a method for liquid ejection comprises the steps of:

moving nozzles, which eject a liquid, in a movement direction;

supporting a medium with a plurality of supporting sections that are arranged at different positions in the movement direction; and forming a pattern for adjusting a liquid ejection timing at a position that depends on the positions of the supporting sections in the movement direction by ejecting the liquid from the nozzles onto the medium supported by the supporting sections.

Features and objects of the present invention other than the above will become clear by reading the description of the present specification with reference to the accompanying drawings.

BRIEF DESCRIPTION OF THE DRAWINGS

In order to facilitate a more complete understanding of the present invention and the advantages thereof, reference is now made to the following description taken in conjunction with the accompanying drawings wherein:

FIG. 8 is an explanatory diagram of the structure of a rotary encoder;

FIG. 9A is a timing chart of a waveform of an output signal during forward rotation, and FIG. 9B is a timing chart of a waveform of an output signal during rotation in reverse;

DESCRIPTION OF PREFERRED EMBODIMENTS

Figure 1:
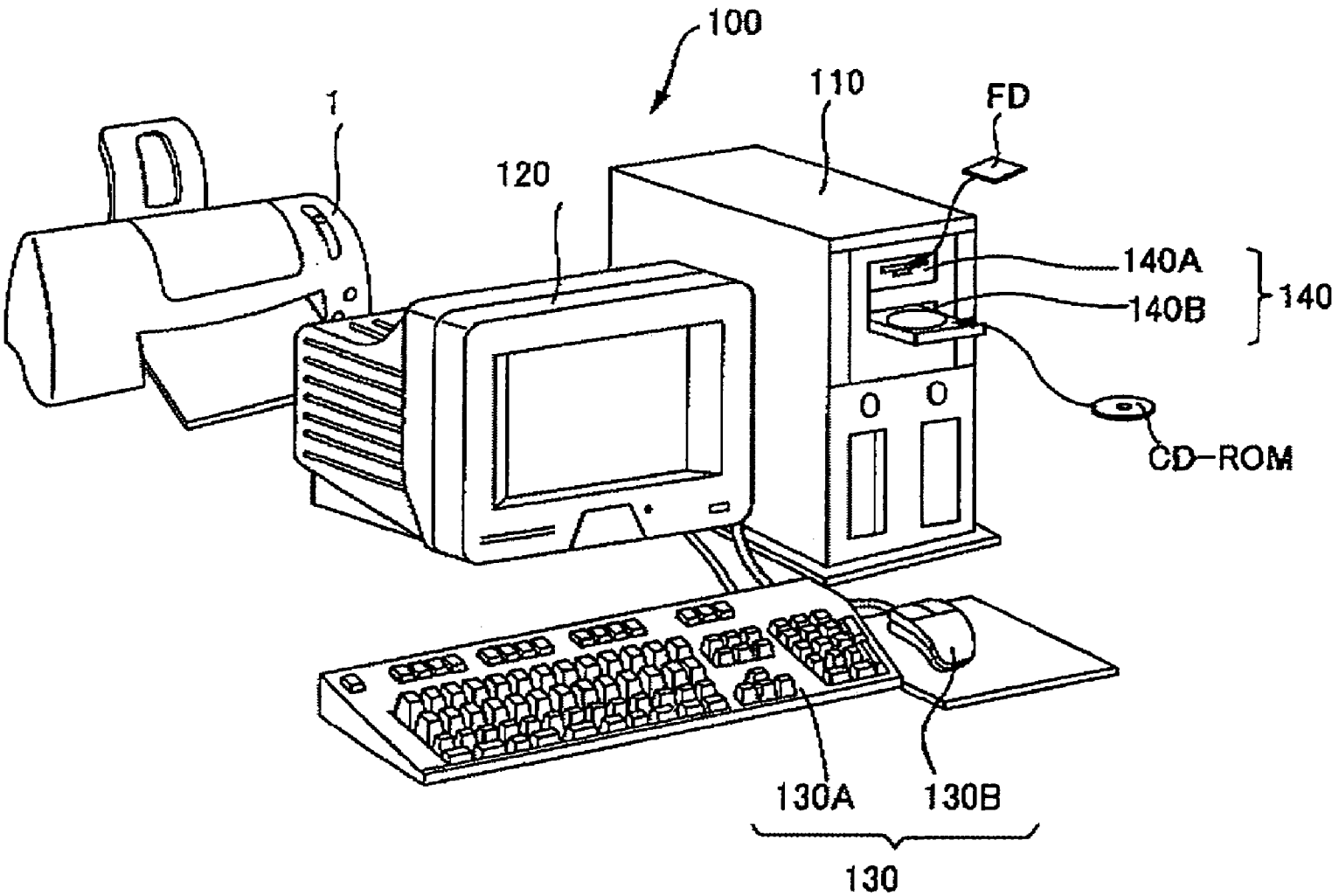
FIG. 1 is an explanatory diagram of an overall configuration of a printing system.

At least the following matters will be made clear by the explanation in the present specification and the description of the accompanying drawings.

A method for liquid ejection comprises the steps of:

moving nozzles, which eject a liquid, in a movement direction;

supporting a medium with a plurality of supporting sections that are arranged at different positions in the movement direction; and forming a plurality of patterns for adjusting a liquid ejection timing by ejecting the liquid from the nozzles onto the medium supported by the supporting sections;

wherein a group of patterns, from among the plurality of patterns, that are formed in the movement direction is a group of patterns for coarse adjustment; and wherein a group of patterns, from among the plurality of patterns, that are formed in a direction that intersects the movement direction is a group of patterns for fine adjustment.

With this liquid ejecting method, it is possible to obtain an adjustment value for causing the ink to land with high accuracy, even from patterns that are formed on paper that has deformed.

In the foregoing liquid ejecting method, it is preferable that each of the plurality of patterns corresponds to a specific adjustment value; and that a difference between the adjustment values of each pattern in the group of patterns for coarse adjustment is twice a difference between the adjustment values of each pattern in the group of patterns for fine adjustment. With this liquid ejecting method, it is possible to substantially increase the number of patterns for fine adjustment.

In the foregoing liquid ejecting method, it is preferable that the plurality of patterns comprises a pattern that is included in the group of patterns for coarse adjustment and in the group of patterns for fine adjustment. With this liquid ejecting method, it is possible to arrange the plurality of adjustment patterns with good efficiency.

In the foregoing liquid ejecting method, it is preferable that the group of patterns for coarse adjustment contains more patterns than the group of patterns for fine adjustment. With this liquid ejecting method, it is possible to shorten the printing time.

In the foregoing liquid ejecting method, it is preferable that the patterns are formed at positions that depend on the positions of the supporting sections in the movement direction. With this liquid ejecting method, it is possible to obtain an adjustment value for causing the ink to land with high accuracy, even from patterns that are formed on paper that has deformed.

Another method for liquid ejection comprises the steps of:

moving nozzles, which eject a liquid, in a movement direction;

supporting a medium with a plurality of supporting sections that are arranged at different positions in the movement direction; and forming a pattern for adjusting a liquid ejection timing at a position that depends on the positions of the supporting sections in the movement direction by ejecting the liquid from the nozzles onto the medium supported by the supporting sections.

According to this liquid ejecting method, it is possible to obtain an adjustment value for causing liquid to land with high accuracy, even from an adjustment pattern that is formed on a medium that has deformed.

In the foregoing liquid ejecting method, it is preferable that a plurality of the patterns are formed along the movement direction. Furthermore, it is preferable that a plurality of the patterns are formed along a carrying direction in which the medium is carried. Furthermore, it is preferable that the plurality of patterns formed along the movement direction constitute a group of patterns for coarse adjustment; and that the plurality of patterns formed along the carrying direction constitute a group of patterns for fine adjustment. Furthermore, it is also preferable that each of the plurality of patterns corresponds to a specific adjustment value; and that a difference between the adjustment values of the patterns that are lined up in the movement direction is larger than a difference between the adjustment values of the patterns that are lined up in the carrying direction. With this liquid ejecting method, it is possible to arrange the plurality of adjustment patterns with good efficiency.

In the foregoing liquid ejecting method, it is preferable that a leading edge of the medium contacts the supporting sections when the medium is carried. Thus, the paper strength increases. Furthermore, it is preferable that the plurality of supporting sections are provided on a platen; and that the medium is carried from above in an obliquely downward direction toward the platen. With this liquid ejecting method, it is possible to prevent the leading edge of the paper from rising up from the platen and rubbing against the head. Furthermore, the amount of deformation of the paper becomes substantially the same each time.

In the foregoing liquid ejecting method, it is preferable that the medium that is supported by the plurality of supporting sections is deformed such that the medium has a concave portion and a convex portion. It is also preferable that the concave portion or the convex portion of the medium runs in the carrying direction in which the medium is carried. Thus, the paper becomes easier to carry.

In the foregoing liquid ejecting method, it is preferable that the pattern is formed between the concave portion and the convex portion of the medium. Thus, it is possible to form an excellent image on the medium.

In the foregoing liquid ejecting method, it is preferable that the pattern is formed between a central position between two supporting sections and the position of one of the two supporting sections. Thus it is possible to form an excellent image on the medium.

In the foregoing liquid ejecting method, it is preferable that a distance between the medium and the nozzles differs depending on the position in the movement direction. With this liquid ejecting method, although the shift in the landing position of the liquid differs according to the position in the movement direction, it is possible to obtain an adjustment value for causing the liquid to land with high accuracy even in such a state.

In the foregoing liquid ejecting method, it is preferable that a plurality of lines are formed in the pattern. With this liquid ejecting method, it is possible to average the influence caused by the difference in the gap within a single pattern.

In the foregoing liquid ejecting method, it is preferable that the nozzles can be moved in both directions by a moving member;

and that the nozzles eject the liquid while the moving member is moving in both directions. With this liquid ejecting method, it is possible to obtain an image of high image quality when printing bi-directionally.

In the foregoing liquid ejecting method, it is preferable that the liquid is an ink.

Furthermore, a liquid ejecting apparatus according to an aspect of the present invention comprises:

a moving member for moving nozzles, which eject a liquid, in a movement direction; and a plurality of supporting sections that are arranged at different positions in the movement direction;

wherein the liquid ejecting apparatus forms a plurality of patterns for adjusting a liquid ejection timing by ejecting the liquid from the nozzles onto a medium supported by the supporting sections;

wherein a group of patterns, from among the plurality of patterns, that are formed in the movement direction is a group of patterns for coarse adjustment; and wherein a group of patterns, from among the plurality of patterns, that are formed in a direction that intersects the movement direction is a group of patterns for fine adjustment.

With this liquid ejecting apparatus, it is possible to obtain an adjustment value for causing the ink to land with high accuracy, even from patterns that are formed on a medium that is deformed.

Furthermore a liquid ejecting apparatus according to another aspect of the present invention comprises:

a moving member for moving nozzles, which eject a liquid, in a movement direction; and a plurality of supporting sections that are arranged at different positions in the movement direction;

wherein the liquid ejecting apparatus forms a pattern for adjusting a liquid ejection timing at a position that depends on the positions of the supporting sections in the movement direction by ejecting the liquid from the nozzles onto a medium supported by the supporting sections.

With this liquid ejecting apparatus, it is possible to obtain an adjustment value for causing the liquid to land with high accuracy, even from an adjustment pattern that is formed on a medium that is deformed.

Configuration of Printing System

An embodiment of a printing system (computer system) is described next with reference to the drawings. It should be noted that the description of the following embodiment also includes embodiments relating to a computer program and a storage medium having recorded thereon a computer program, for example.

FIG. 1 is an explanatory drawing showing the external structure of a printing system. A printing system 100 is provided with a printer 1, a computer 110, a display device 120, an input device 130, and a recording-and-playing device 140. The printer 1 is a printing apparatus for printing images on a medium such as paper, cloth, or film. The computer 110 is electrically connected to the printer 1, and outputs print data corresponding to an image to be printed to the printer 1 in order to cause the printer 1 to print the image. The display device 120 has a display, and displays a user interface such as an application program or a printer driver. The input device 130 is, for example, a keyboard 130A and a mouse 130B, and is used to operate the application program or adjust the settings of the printer driver, for example, in accordance with the user interface that is displayed on the display device 120. A flexible disk drive device 140A and a CD-ROM drive device 140B, for example, are employed as the recording-and-playing device 140.

A printer driver is installed on the computer 110. The printer driver is a program for achieving the function of displaying the user interface on the display device 120, and in addition it also achieves the function of converting image data that have been output from the application program into print data. The printer driver is recorded on a storage medium (computer-readable storage medium) such as a flexible disk FD or a CD-ROM. Also, the printer driver can be downloaded onto the computer 110 via the Internet. It should be noted that this program is made of codes for achieving various functions.

It should be noted that "printing apparatus" in a narrow sense means the printer 1, but in a broader sense it means the system constituted by the printer 1 and the computer 110.

Configuration of Printer

<Regarding the Configuration of an Inkjet Printer>

Figure 2:
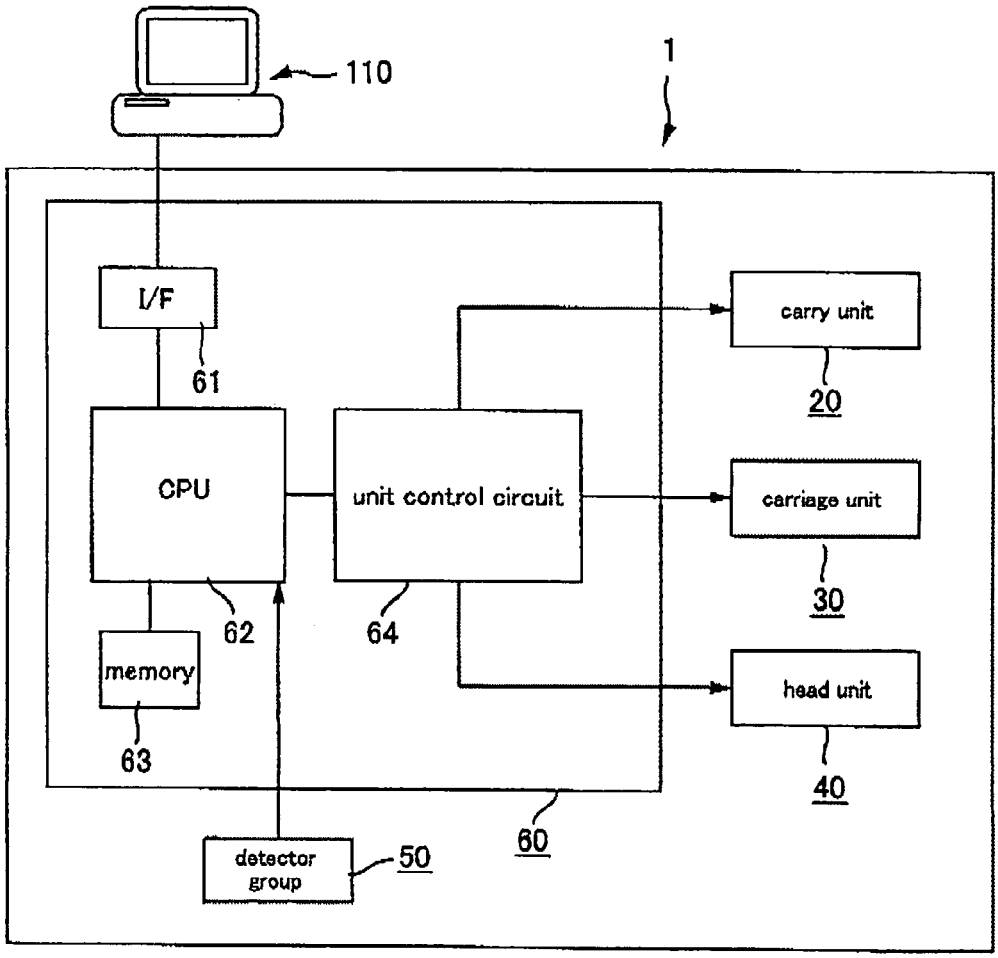
FIG. 2 is a block diagram of an overall configuration of a printer.
Figure 3:
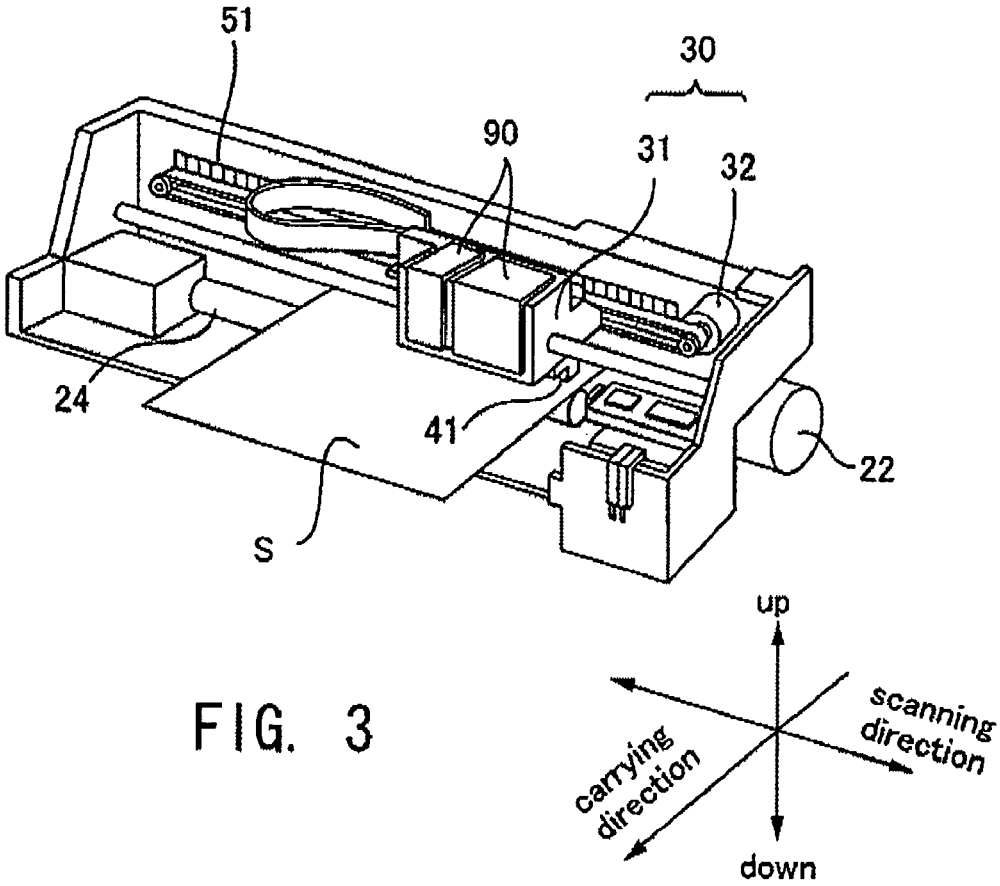
FIG. 3 is a schematic diagram of an overall configuration of the printer.
Figure 4:
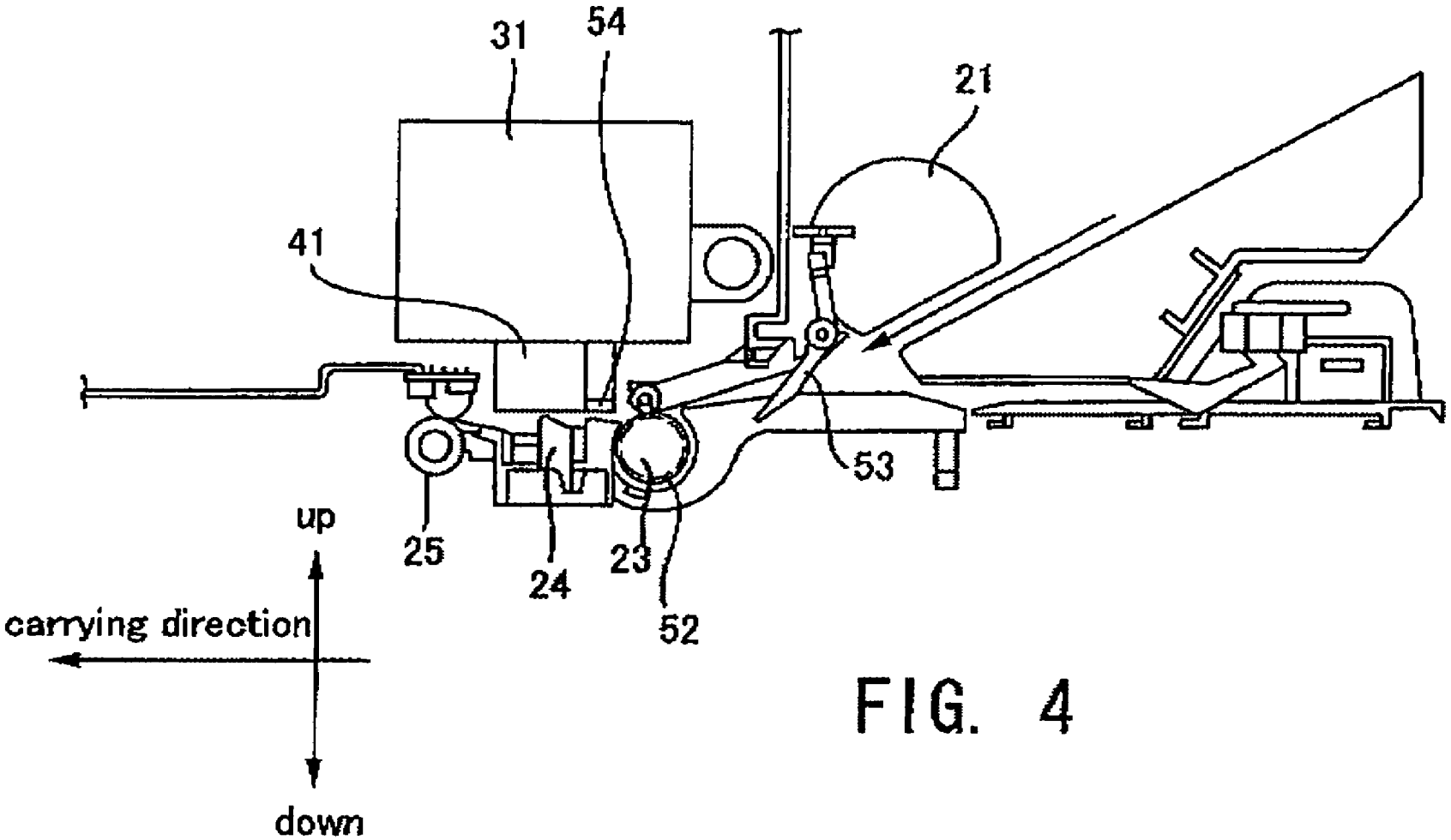
FIG. 4 is a transverse sectional view of an overall configuration of the printer.

FIG. 2 is a block diagram of an overall configuration of a printer according to the present embodiment. FIG. 3 is a schematic diagram of the overall configuration of the printer of this embodiment. FIG. 4 is a transverse sectional view of the overall configuration of the printer of this embodiment. The basic configuration of the printer according to the present embodiment is described below.

The printer of this embodiment has a carry unit 20, a carriage unit 30, a head unit 40, a detector group 50, and a controller 60. The printer 1 that has received print data from the computer 110, which is an external device, controls the various units (the carry unit 20, the carriage unit 30, and the head unit 40) with the controller 60. The controller 60 controls the units in accordance with the print data that are received from the computer 110 to form an image on a paper. The detector group 50 monitors the conditions within the printer 1, and it outputs the results of this detection to the controller 60. The controller 60 receives the detection results from the detector group 50, and controls the units based on these detection results.

The carry unit 20 is for feeding a medium (for example, paper S) to a printable position and carrying the paper in a predetermined direction (hereinafter, referred to as the "carrying direction") by a predetermined carry amount during printing. In other words, the carry unit 20 functions as a carrying mechanism (a carrying means) for carrying paper. The carry unit 20 has a paper supply roller 21, a carry motor 22 (hereinafter, referred to also as a "PF motor"), a carry roller 23, a platen 24, and a paper discharge roller 25. It should be noted that the carry unit 20 does not necessarily have to include all of these structural elements in order to function as a carrying mechanism. The paper supply roller 21 is a roller for automatically supplying, into the printer, paper that has been inserted into a paper insert opening. The paper supply roller 21 has a cross-sectional shape in the shape of the letter D, and the length of its circumferential portion is set longer than the carrying distance up to the carry roller 23, so that using this circumferential portion the paper can be carried up to the carry roller 23. The carry motor 22 is a motor for feeding paper in the paper carrying direction, and is constituted by a DC motor The carry roller 23 is a roller for carrying the paper S that has been supplied by the paper supply roller 21 up to a printable region, and is driven by the carry motor 22. The platen 24 supports the paper S during printing. The paper is charge roller 25 is a roller for discharging the paper S, for which printing has finished, out of the printer. The paper discharge roller 25 is rotated in synchronization with the carry roller 23.

The carriage unit 30 is for making the head move (carry out scanning movement) in a predetermined direction (hereinafter, this is referred to as the "scanning direction"). The carriage unit 30 has a carriage 31 and a carriage motor (also referred to as a "CR motor") 32. The carriage 31 is capable of moving back and forth in the scanning direction (and thus, the head moves in the scanning direction). Also, the carriage 31 detachably holds ink cartridges 90 containing ink. The carriage motor 32 is a DC motor for moving the carriage 31 in the scanning direction.

The head unit 40 is for ejecting ink onto the paper. The head unit 40 has a head 41. The head 41 has a plurality of nozzles, which are ink ejection sections, and ejects ink intermittently from each of the nozzles. The head 41 is provided on the carriage 31. Thus, when the carriage 31 moves in the scanning direction, the head 41 also moves in the scanning direction. A dot line (raster line) is formed on the paper in the scanning direction as a result of the head 41 intermittently ejecting ink while moving in the scanning direction.

The detector group 50 includes, for example, a linear encoder 51, a rotary encoder 52, a paper detection sensor 53, and an optical sensor 54. The linear encoder 51 is for detecting the position of the carriage 31 in the scanning direction. The rotary encoder 52 is for detecting the amount of rotation of the carry roller 23. The paper detection sensor 53 is for detecting the position of the leading edge of the paper to be printed. The paper detection sensor 53 is provided in a position where it can detect the position of the leading edge of the paper as the paper is being fed toward the carry roller 23 by the paper supply roller 21. It should be noted that the paper detection sensor 53 is a mechanical sensor that detects the leading edge of the paper through a mechanical mechanism. More specifically, the paper detection sensor 53 has a lever that can be rotated in the carrying direction, and this lever is arranged such that it protrudes into the path over which the paper is carried. In this way, the leading edge of the paper comes into contact with the lever and the lever is rotated, and thus the paper detection sensor 53 detects the position of the leading edge of the paper by detecting movement of the lever. The optical sensor 54 is attached to the carriage 31. The optical sensor 54 detects whether or not the paper is present by irradiating light onto the paper from its light-emitting section and detecting the reflected light with its light-receiving section. The optical sensor 54 detects the positions of the edges of the paper while being moved by the carriage 41. The optical sensor 54 optically detects the edges of the paper, and thus has higher detection accuracy than the mechanical paper detection sensor 53.

The controller 60 is a control unit (controlling means) for carrying out control of the printer. The controller 60 has an interface section 61, a CPU 62, a memory 63, and a unit control circuit 64. The interface section 61 exchanges data between the computer 110, which is an external device, and the printer 1. The CPU 62 is an arithmetic processing unit for carrying out overall control of the printer. The memory 63 is for reserving, for example, a working region and a region for storing the programs for the CPU 62, and includes memory means such as a RAM or an EEPROM. The CPU 62 controls the various units via the unit control circuit 64 in accordance with programs stored in the memory 63.

<Regarding the Printing Operation>

Figure 5:
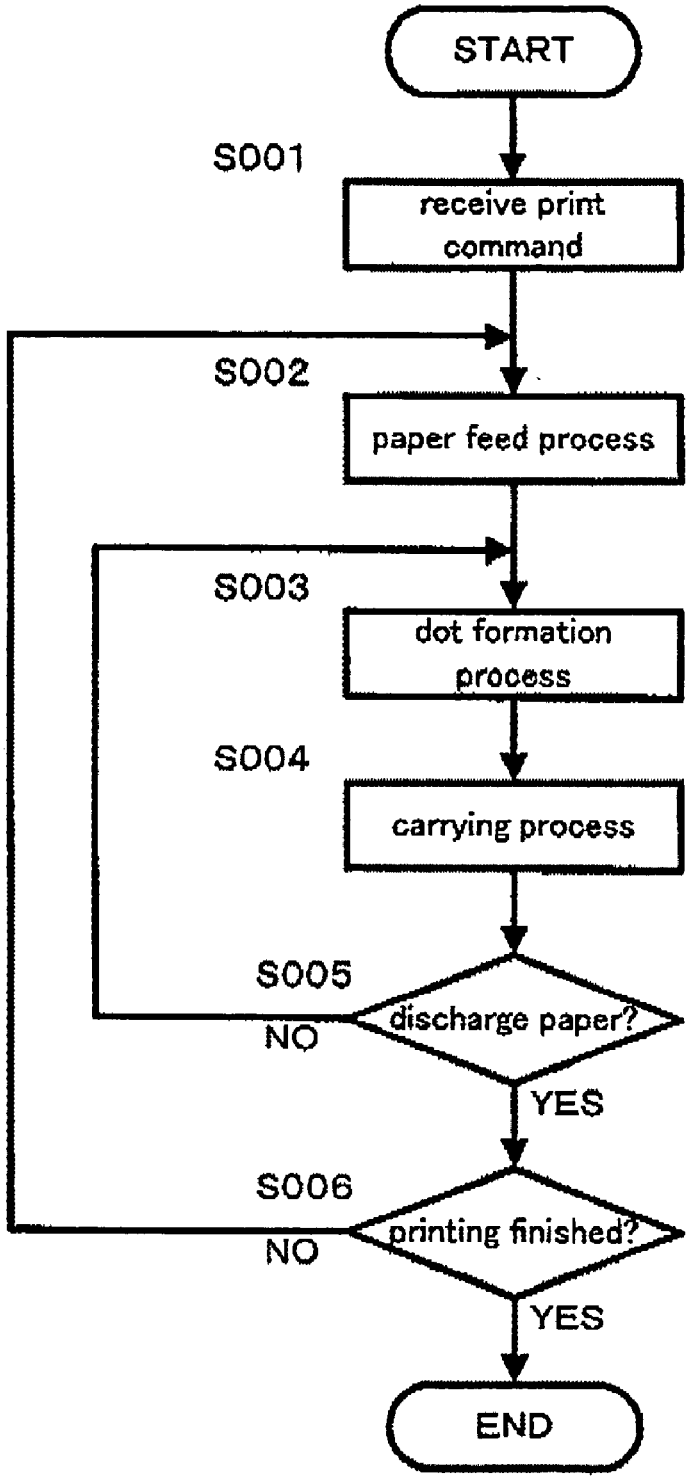
FIG. 5 is a flowchart of the processing during printing.

FIG. 5 is a flowchart of the processing during printing. The processes described below are executed by the controller 60 controlling the various units in accordance with a program stored in the memory 63. This program includes codes for executing the various processes.

The controller 60 receives a print command via the interface section 61 from the computer 110 (S001). This print command is included in the header of the print data transmitted from the computer 110. The controller 60 then analyzes the content of the various commands included in the print data that has been received and uses the units to perform the following paper supply process, carrying process, and ink ejection process, for example.

First, the controller 60 performs the paper supply process (S002). The paper supply process is a process for supplying paper to be printed into the printer and positioning the paper at a print start position (also referred to as the "indexing position"). The controller 60 rotates the paper supply roller 21 to feed the paper to be printed up to the carry roller 23. The controller 60 then rotates the carry roller 23 to position the paper that has been fed from the paper supply roller 21 at the print start position. When the paper has been positioned at the print start position, at least some of the nozzles of the head 41 are in opposition to the paper.

Next, the controller 60 performs the dot formation process (S003). The dot formation process is a process of intermittently ejecting ink from the head, which moves in the scanning direction, so as to form dots on the paper. The controller 60 drives the carriage motor 32 to move the carriage 31 in the scanning direction. The controller 60 then causes the head to eject ink in accordance with the print data during the period that the carriage 31 is moving. Dots are formed on the paper when ink droplets ejected from the head land on the paper.

Next, the controller 60 performs the carrying process (S004). The carrying process is a process for moving the paper in the carrying direction relative to the head. The controller 60 drives the carry motor to rotate the carry roller and thereby carry the paper in the carrying direction. Through this carrying process, the head 41 can form dots at positions that are different from the positions of the dots formed in the preceding dot formation process.

Next, the controller 60 determines whether or not to discharge the paper being printed (S005). The paper is not discharged if there still is data for printing on the paper, which is being printed. In this case, the controller 60 alternately repeats the dot formation and carrying processes until there is no more data for printing, thereby gradually printing, on the paper, an image made of dots. When there is no more data for printing the paper being printed, the controller 60 discharges that paper. The controller 60 discharges the printed paper to the outside by rotating the paper discharge roller. It should be noted that whether or not to discharge the paper may also be determined based on a paper discharge command included in the print data.

Next, the controller 60 determines whether or not to continue printing (S006). If the next sheet of paper is to be printed, then printing is continued and the paper supply process for the next sheet of paper is started. If the next sheet of paper is not to be printed, then the printing operation is ended.

<Regarding the Nozzles>

Figure 6:
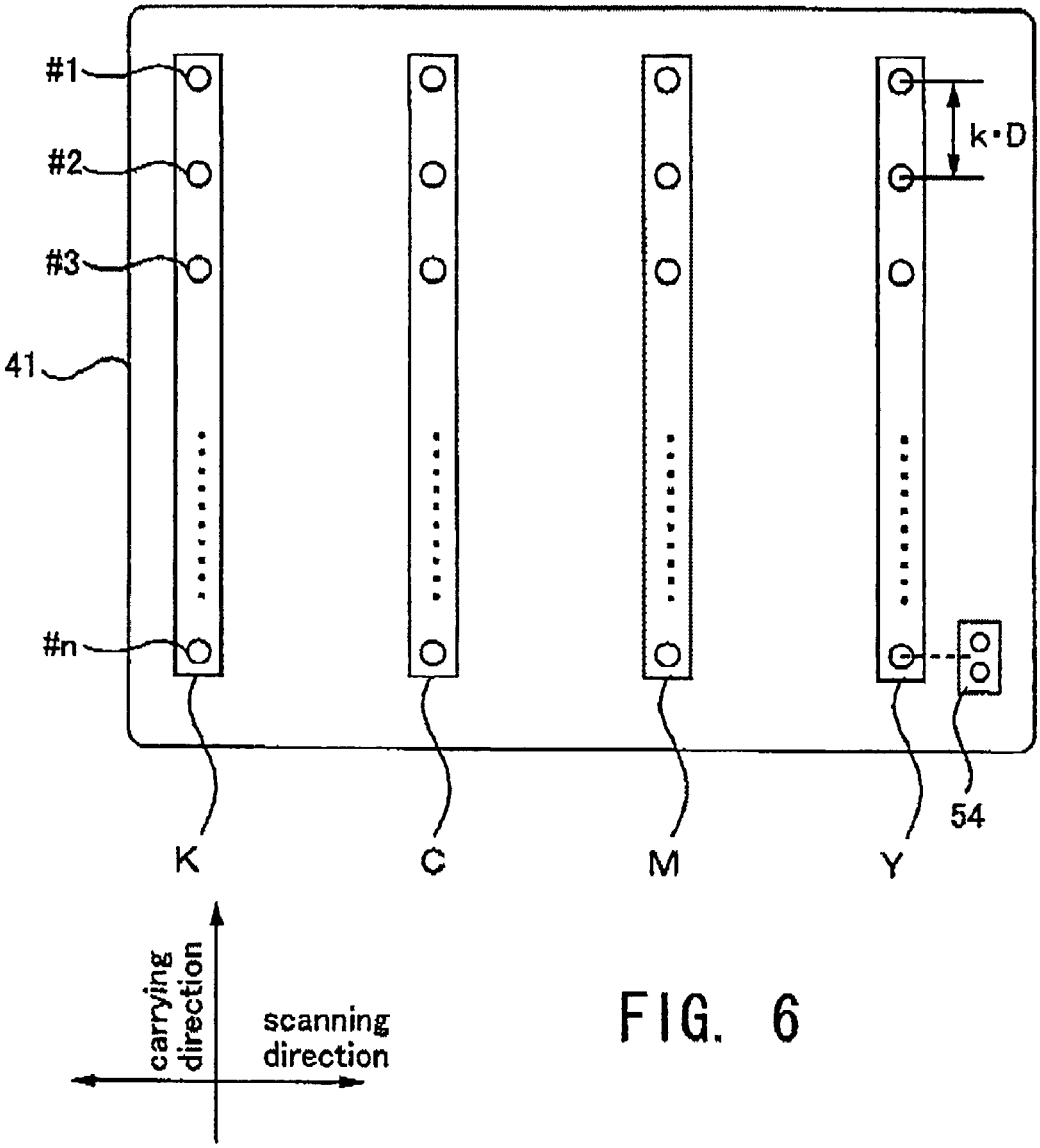
FIG. 6 is an explanatory diagram showing the arrangement of nozzles.

FIG. 6 is an explanatory diagram showing the arrangement of nozzles in the lower surface of the head 41. A black ink nozzle group K, a cyan ink nozzle group C, a magenta ink nozzle group M, and a yellow ink nozzle group Y are formed in the lower surface of the head 41. Each nozzle group is provided with a plurality of nozzles (in this embodiment, 180 nozzles), which are ejection openings for ejecting ink of the respective colors.

The plurality of nozzles of the nozzle groups are arranged in a row at a constant spacing (nozzle pitch: k•D) in the carrying direction. Here, D is the minimum dot pitch in the carrying direction (that is, the interval between dots, which are formed on the paper S, at the maximum resolution). Furthermore, k is an integer that is 1 or greater. For example, if the nozzle pitch is 180 dpi (1/180 inch), and the dot pitch in the carrying direction is 720 dpi (1/720), then k=4.

The nozzles in each nozzle group are assigned a number (#1 to #180) that becomes smaller the more downstream the nozzle is positioned. That is, the nozzle #1 is positioned more downstream in the carrying direction than the nozzle #180. Each nozzle is provided with a piezo element (not shown) as a drive element for driving the nozzle and causing it to eject an ink droplet. Also, the optical sensor 54 is provided substantially in the same position as the nozzle #180, which is on the most upstream side, as regards its position in the paper carrying direction.

Carrying Process

<Regarding the Carrying Process>

Figure 7:
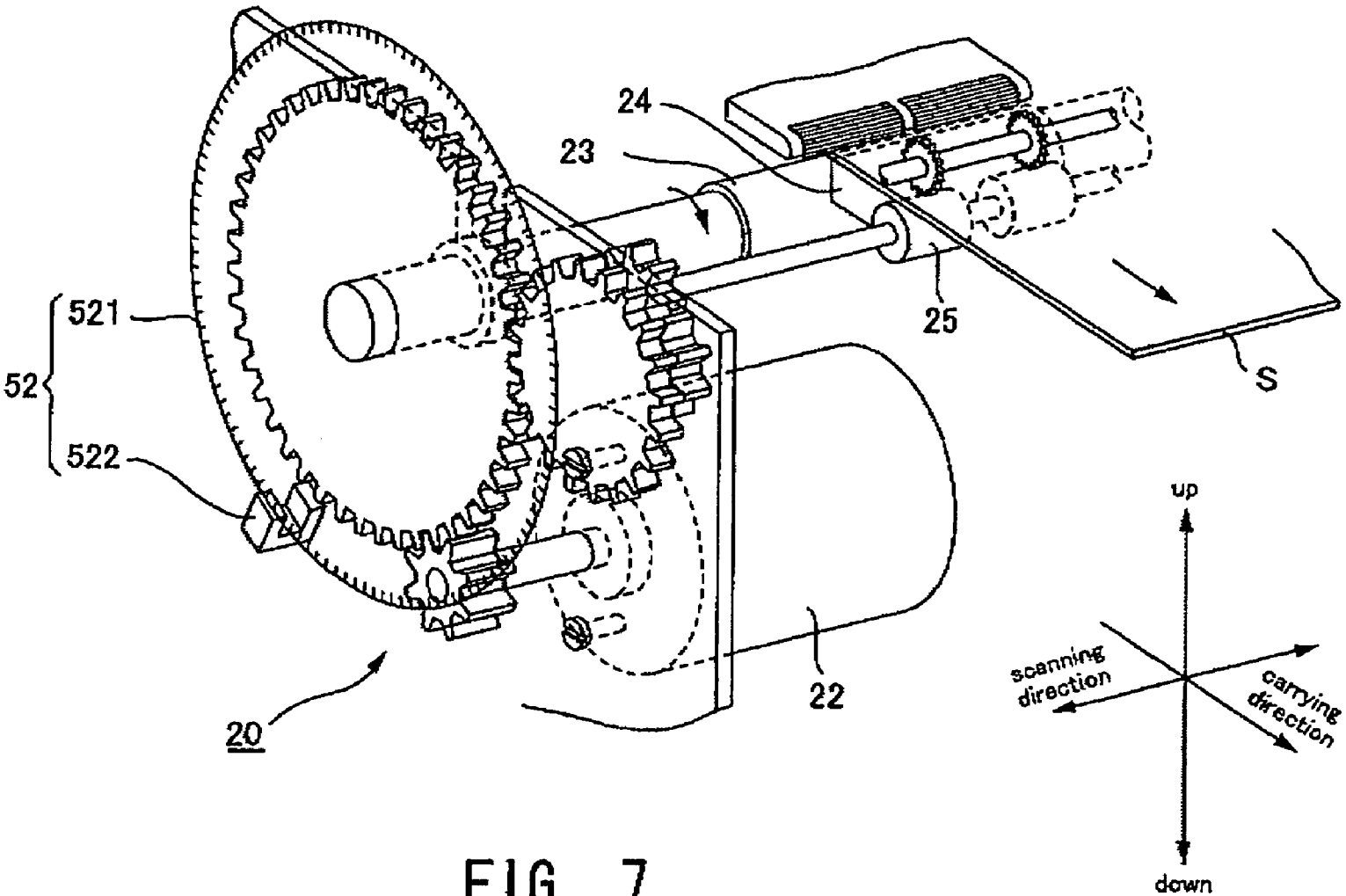
FIG. 7 is an explanatory diagram of the structure of a carry unit.

FIG. 7 is an explanatory diagram of showing the structure of the carry unit 20. It should be noted that in this diagram, structural elements that have already been described are assigned identical reference numerals and further description thereof has been omitted.

The carry unit 20 drives the carry motor 22 by a predetermined drive amount in accordance with a carry command from the controller. The carry motor 22 generates a drive force in the rotation direction that corresponds to the drive amount that has been ordered. The carry motor 22 then rotates the carry roller 23 using this drive force The carry motor 22 also rotates the paper discharge roller 25 using this drive force. That is, when the carry motor 22 generates a predetermined drive amount, the carry roller 23 and the paper discharge roller 25 rotate by a predetermined rotation amount. When the carry roller 23 and the paper discharge roller 25 are rotated by the predetermined rotation amount, the paper is carried by a predetermined carry amount. Because the carry roller 23 and the paper discharge roller 25 rotate in synchronization, the paper can be carried by the carry unit 20 as long as the paper is in contact with at least one of the carry roller 23 and the paper discharge roller 25.

The carry amount, by which the paper is carried, is determined according to the rotation amount of the carry roller 23. Consequently, it the rotation amount of the carry roller 23 can be detected, then it is also possible to detect the carry amount of the paper. Accordingly, the rotary encoder 52 is provided in order to detect the rotation amount of the carry roller 23.

<Regarding the Structure of the Rotary Encoder>

FIG. 8 is an explanatory diagram of the configuration of the rotary encoder. It should be noted that in this diagram, structural elements that have already been described are assigned identical reference numerals and further description thereof has been omitted.

The rotary encoder 52 has a scale 521 and a detecting section 522.

The scale 521 has numerous slits provided at predetermined intervals. The scale 521 is provided in the carry roller 23. That is, the scale 521 rotates together with the carry roller 23 when the carry roller 23 is rotated. For example, when the carry roller 23 is rotated such that the paper S is carried by 1/1440 inch, the scale 521 is rotated by one slit with respect to the detecting section 522.

The detecting section 522 is provided in opposition to the scale 521, and is fastened on the printer body side. The detecting section 522 has a light-emitting diode 522A, a collimating lens 522B, and a detection processing section 522C. The detection processing section 522C is provided with a plurality of (for instance, four) photodiodes 522D, a signal processing circuit 522E, and two comparators 522Fa and 522Pb.

The light-emitting diode 522A emits light when a voltage Vcc is applied to it via resistors on both sides, and this light is incident on the collimating lens. The collimating lens 522B turns the light that is emitted from the light-emitting diode 522A into parallel light, and irradiates the parallel light on the scale 521. The parallel light that has passed through the slits provided in the scale then passes through stationary slits (not shown) and is incident on the photodiodes 522D. The photodiodes 522D convert the incident light into electrical signals. The electrical signals that are output from the photodiodes are compared in the comparators 522Fa and 522Fb, and the results of these comparisons are output as pulses. Then, the pulse ENC-A and the pulse ENC-B that are output from the comparators 522Fa and 522Fb become the output of the rotary encoder 52.

<Regarding the Signals of the Rotary Encoder>

FIG. 9A is a timing chart of the waveforms of the output signals when the carry motor 22 is rotating forward. FIG. 9B is a timing chart of the waveforms of the output signals when the carry motor 22 is rotating in reverse.

As shown in FIG. 9A and FIG. 9B, the phases of the pulse ENC-A and the pulse ENC-B are misaligned by 90 degrees both when the carry motor 12 is rotating forward and when it is rotating in reverse. When the carry motor 22 is rotating forward, that is, when the paper S is carried in the carrying direction, then the phase of the pulse ENC-A leads the phase of the pulse ENC-B by 90 degrees. On the other hand, when the carry motor 22 is rotating in reverse, that is, when the paper S is carried in the direction opposite from the carrying direction, then the phase of the pulse ENC-A trails the phase of the pulse ENC-B by 90 degrees. A single period T of the pulses is the same as the time during which the carry roller 23 is rotated by an interval of the slits of the scale 521 (for example, by 1/1440 inch (1 inch=2.54 cm)).

By counting the number of pulse signals with the controller, the rotation amount of the carry roller 23 can be detected, and thus the carry amount of the paper can be detected. Also, by detecting a single period T of the pulses with the controller, the rotation velocity of the carry roller 23 can be detected, and thus the carry velocity of the paper can be detected.

<Regarding the Flow of Carrying>

Figure 10:
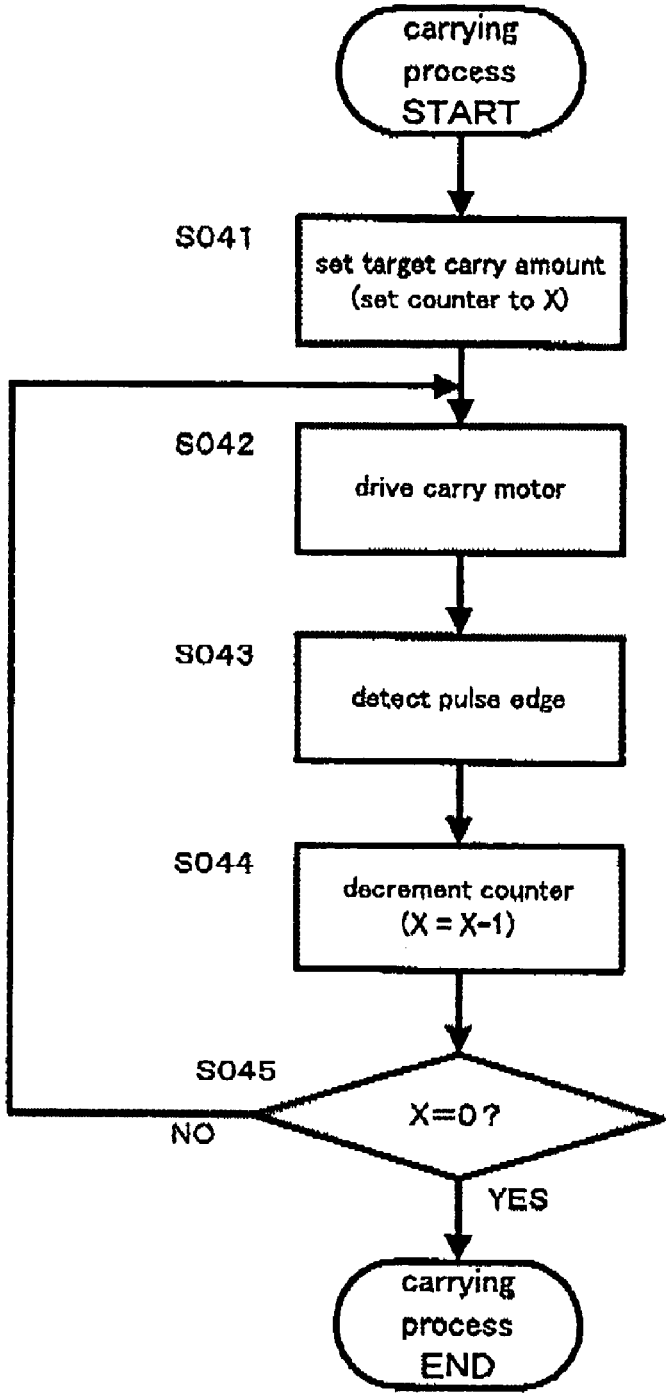
FIG. 10 is a flowchart of the carrying process.

FIG. 10 is a flowchart of the carrying process. The various operations that are described below are achieved by the controller controlling the carry unit 20 based on a program stored in the memory in the printer 1. Also, this program is made of codes for performing the various operations described below.

First, the controller sets a target carry amount (S041). The target carry amount is a value determining the drive amount of the carry unit 20 in order for the carry unit 20 to carry the paper S by a carry amount that has been defined as a target. The target carry amount is determined based on carry command data (information about the target carry amount)

included in the print data that are received from the computer side. The target carry amount is set by setting the value of the counter with the controller. In the following description, the target carry amount is defined as X, and thus the controller sets the value of the counter to X.

Next, the controller drives the carry motor 22 (S042). When the carry motor 22 generates a predetermined drive amount, the carry roller 23 is rotated by a predetermined rotation amount. Then, the slits 521 provided on the carry roller 23 are also rotated when the carry roller 23 is rotated by the predetermined rotation amount.

Next, the controller detects the edge of the pulse signal of the rotary encoder (S043). That is, the controller detects the rising edge or the falling edge of the pulse ENC-A or the pulse ENC-B. For example, if the controller detects one edge, then this means that the carry roller 23 has carried the paper S by a carry amount of $1/1440$ inch.

When the controller has detected an edge of the pulse signal of the rotary encoder, the controller subtracts this from the value of the counter (S044). That is, if the value of the counter is X, then the controller sets the value of the counter to X−1 when it has detected one edge of the pulse signal.

Next, the controller repeats the operations of S042 to S044 until the value of the counter becomes zero (S045). That is, the controller drives the carry motor 22 until the same number of pulses as the value initially set in the counter have been detected. In this fashion, the carry unit 20 carries the paper S in the carrying direction by a carry amount that corresponds to the value initially set in the counter.

For example, for the carry unit 20 to carry the paper S by $90/1440$ inch, the controller sets the value of the counter to 90, thereby setting the target carry amount. The controller then decrements the value of the counter each time that it detects a rising edge or a falling edge of the pulse signal of the rotary encoder. Then, when the value of the counter has reached zero, the controller ends the carrying operation. This is because the detection of 90 pulse signals means that the carry roller 23 has carried the paper S by $90/1440$ inch. Consequently, if the controller sets the value of the counter to 90 as the settings for the target carry amount, then the result is that the carry unit 20 carries the paper S by $90/1440$ inch.

It should be noted that in the foregoing description, the controller detects the rising edge or the falling edge of the pulse ENC-A or the pulse ENC-B, but it is also possible for it is detect both edges of the pulse ENC-A and the pulse ENC-B. The cycles of the pulse ENC-A and the pulse ENC-B are equal to the slit intervals of the scales 521 and the phases of the pulse ENC-A and the pulse ENC-B are misaligned by 90 degrees, and therefore, detection by the controller of either the rising edge or the falling edge of the pulses means that the carry roller 23 has carried the print paper by $1/5760$ inch. In the present case, if the controller sets the value of the counter to 90, then the carry unit 20 carries the paper S by $90/5760$ inch.

The foregoing description is for a single carrying operation. If the printer is to intermittently perform the carrying operation for a plurality of times, then the controller sets the target carry amount (sets the value of the counter) each time the carrying operation is finished, and the carry unit 20 carries the paper S in accordance with the target carry amount that has been set.

Incidentally, the rotary encoder 52 directly detects the rotation amount of the carry roller 23, and strictly speaking, does not detect the carry amount of the paper S. That is, if slippage occurs between the carry roller 23 and the paper S, then the rotation amount of the carry roller 23 and the carry amount of the paper S will not match, and thus the rotary encoder 52 cannot accurately detect the carry amount of the paper S, resulting in a carry error (detection error) when slippage occurs between the carry roller 23 and the paper S in this manner, it is necessary for the controller to rotate the carry roller 23 by a larger carry amount than the target carry amount in order for the carry unit 20 to carry the paper S by the target carry amount. Accordingly, the controller is capable of correcting the target carry amount and setting the counter to a value that corresponds to the corrected target carry amount in order to carry the paper S by the most suitable carry amount.

Configuration of Platen

There is a printing method called "borderless printing". In this printing method, an image is formed on the entirety of the paper without any margins. When the printer performs "borderless printing", ink is ejected onto a region that is wider than the paper, ink coats the entirety of the paper, and an image is formed on the entirety of the paper.

In the case of "borderless printing", because the ink is ejected onto a region that is wider than the paper, there is ink that does not land on the paper but lands on the platen. However, this is not preferable because the paper is soiled when the ink that lands on the platen adheres to the back side of the paper. Therefore, in order to prevent soiling of the back side of the paper, the platen 24 is provided with protrusions (supporting sections) such that the portions of the platen to which ink droplets have adhered do not contact the paper.

Figure 11A:
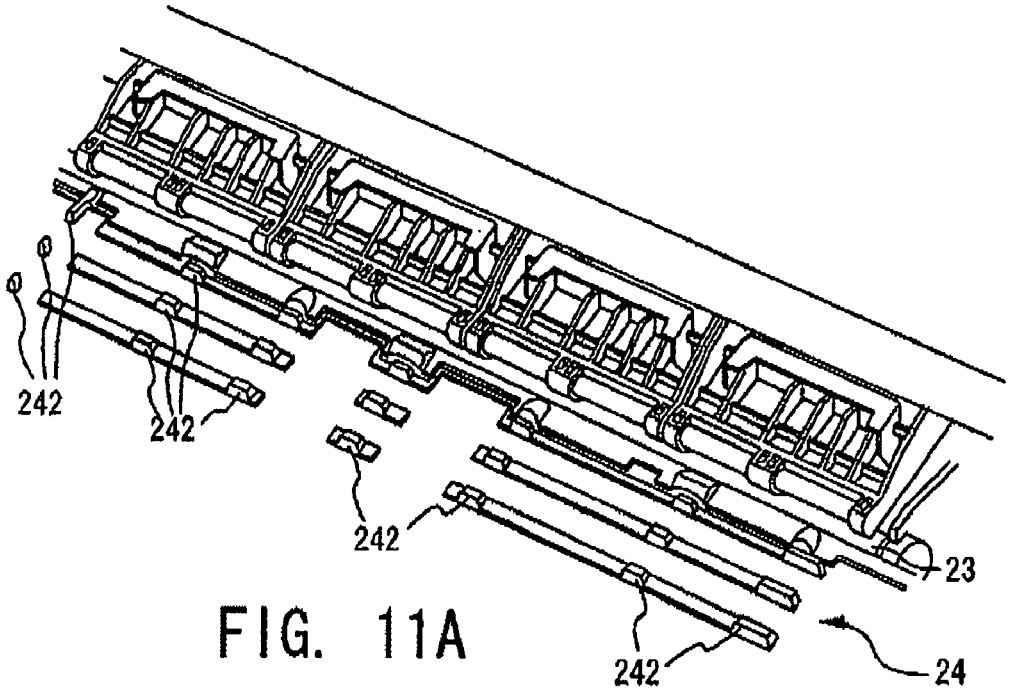
FIG. 11A is a perspective view of structural elements in the vicinity of a platen.
Figure 12A:
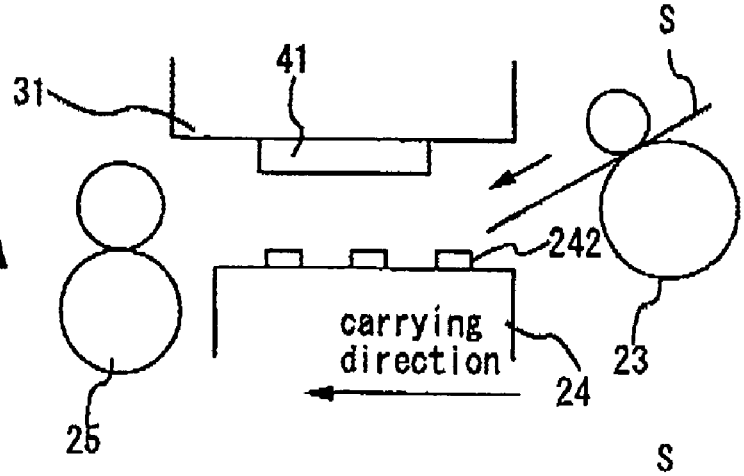
FIG. 12A and FIG. 12B are views of the paper that is carried, as seen from the side (a scanning direction)
Figure 12B:
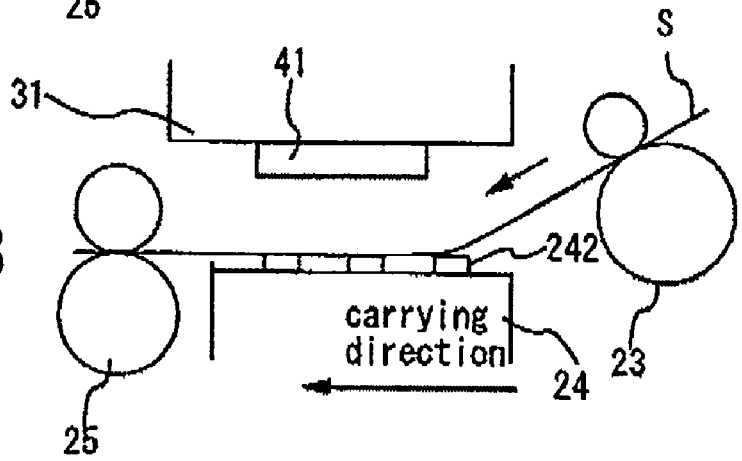

FIG. 11A is a perspective view of structural elements in the vicinity of the platen 24. FIG. 11D is a perspective view of paper that is carried by the carry roller 23. FIG. 12A and FIG. 12B show how the paper is carried, as seen from the side (scanning direction). In these figures, structural elements that have already been described are assigned identical reference numerals and further description thereof has been omitted.

The platen 24 is provided with a plurality of protrusions 242 (also called convex portions). A plurality of these protrusions 242 are arranged in lines in the scanning direction. Accordingly, the respective protrusions 242 are arranged at different positions in the scanning direction. The plurality of protrusions that are lined up in the scanning direction constitute a protrusion group.

A plurality of the protrusion groups (each of which being constituted by the plurality of protrusions 242 that are lined up in the scanning direction) are arranged in the carrying direction. Accordingly, groove sections (also called concave portions) running in the scanning direction are formed between adjacent protrusion groups. The positions, in the scanning direction, of the protrusions 242 in each protrusion group are substantially the same among all of the protrusion groups. Consequently, groove sections running in the carrying direction are formed between the protrusions.

Ink that does not land on the paper during borderless printing lands in the groove sections. Because the printer performs borderless printing with respect to various sizes of paper (for example, postcard, B5, and A4), a plurality of groove sections running along the carrying direction are provided to comply with the positions of the side edges of the paper of each size. Furthermore, as there is also the necessity to carry out borderless printing on upper and lower edges of the paper, at least two groove sections are formed along the scanning direction. In other words, the plurality of protrusions 242 are formed so as to form the groove sections described above.

The paper that has been carried by the carry roller 23 is carried from above in an obliquely downward direction toward the platen 24 (FIG. 12A). The leading edge of the paper that is carried obliquely contacts the protrusions 242 of the platen 24. When the leading edge of the paper comes into contact with the protrusions 242 that are arranged in the scanning direction, the leading edge becomes wave-shaped when viewed from the carrying direction. When the carry roller continues to carry the paper, the paper that is supported by the protrusions 242 of the platen 24 becomes wave-shaped (undulating) in the scanning direction and becomes pleated like a bellows (becomes accordion-shaped). However, the shape of the paper in the carrying direction is not undulating. That is, the peak portions of the wavy paper run along the carrying direction, and the trough portions also run along the carrying direction. And, the peak portions and the trough portions appear alternately in the scanning direction.

Because the paper that is carried in the carrying direction has such a shape, the paper can be carried without warping. Thus, while carrying the paper, it is possible to prevent the leading edge of the paper from entering the groove sections that are formed along the scanning direction and jamming up, and to prevent the leading edge of the paper from rising up from the platen 24 and rubbing against the head.

Figure 13:
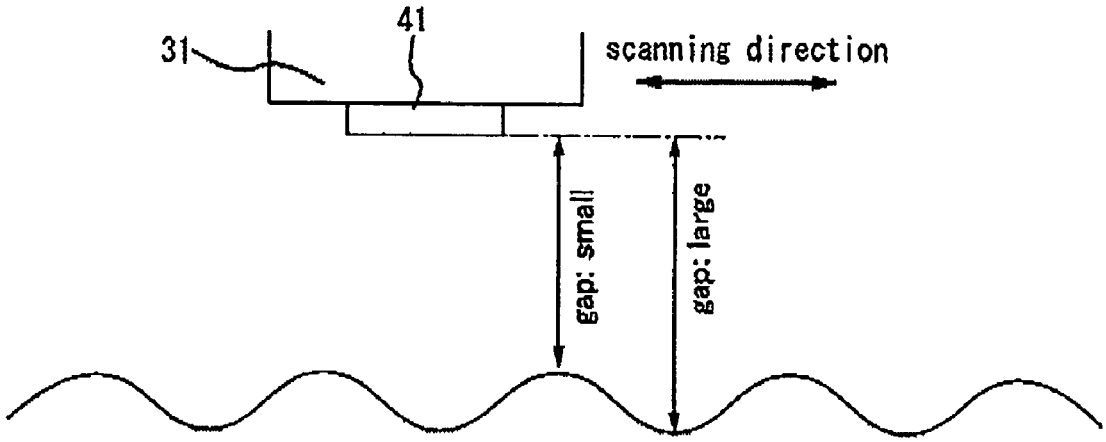
FIG. 13 is an explanatory diagram of the distance between the head (the nozzles) and the paper.

FIG. 13 is an explanatory diagram of the distance between the head (the nozzles) and the paper. This figure shows the state of the paper that is carried, as viewed from the carrying direction. As described above, the paper is accordion-shaped on the platen. That is, the paper is accordion-shaped in the printing region (the region in which ink is applied to the paper by the nozzles). Since the paper is in an accordion-shape, the distance between the head and the paper (which is called the "gap" below) differs according to the position in the scanning direction.

Figure 14A:
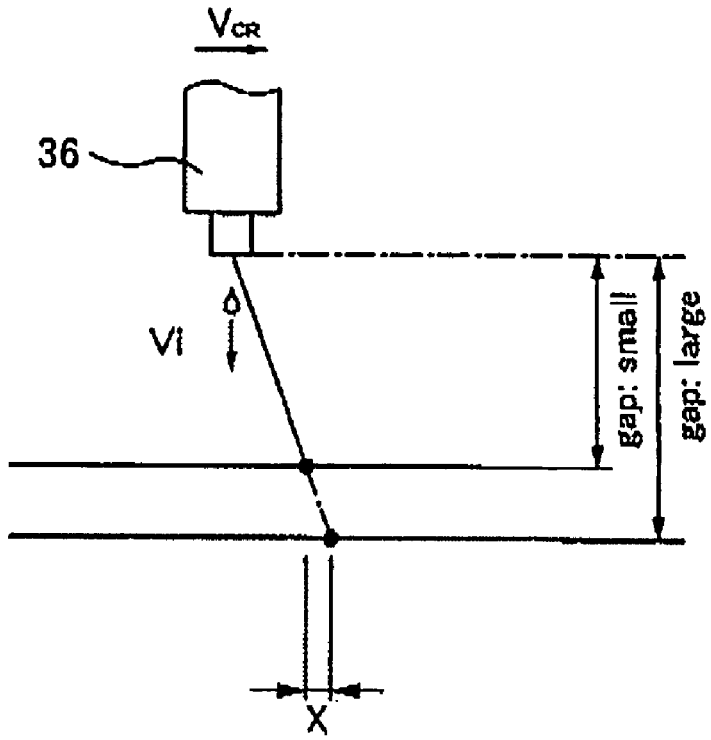
FIG. 14A is an explanatory diagram of a change in ink landing position caused due to a gap.

FIG. 14A is an explanatory diagram showing the change in the ink landing position caused by the gap. The carriage 36 is moved in the scanning direction at a velocity VCR. On the other hand, the ink droplets that are ejected from the head fly in the vertical direction at a velocity Vi and land on the paper. If the gap is large, then because the distance that the ink droplets fly is also large and the time taken until the ink droplets land increases, the landing position is shifted further downstream in the movement direction compared to when the gap is small.

Figure 14B:
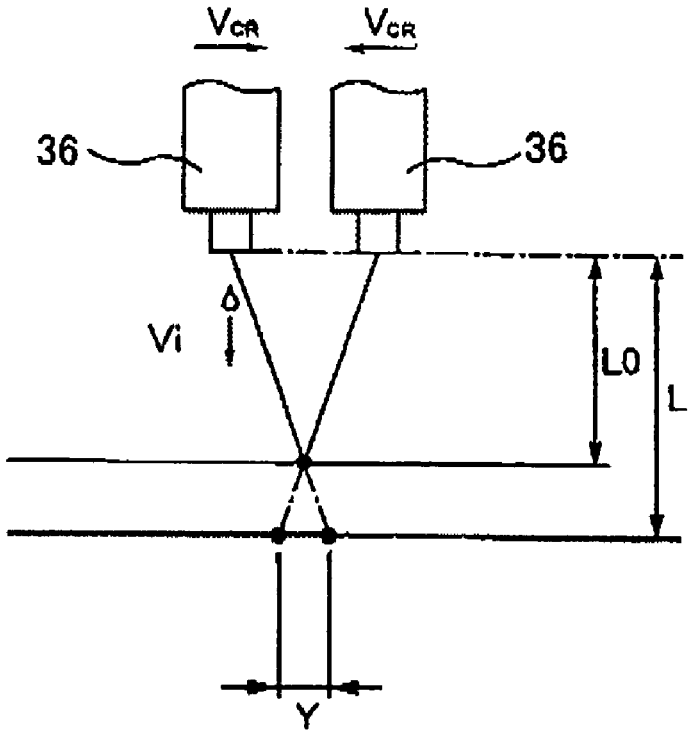
FIG. 14B is an explanatory diagram of a shift in ink landing position during bi-directional printing.

FIG. 14B is an explanatory diagram showing the shift in the ink landing position during bi-directionally printing. The ink is ejected from the head while the carriage 36 moves back and forth. The ink ejection timing during bi-directional printing is adjusted such that, at a predetermined gap L0, the ink landing position during the forward pass matches the ink landing position during the return pass. When the gap differs from the standard gap L0, the landing position during bi-directional printing is shifted as shown in the figure.

In the present embodiment, because the gap differs according to the position in the scanning direction as shown in FIG. 13, the amount of shift in the landing position differs depending on the position in the scanning direction. However, since image quality deteriorates when the shift in the landing position is large, it is preferable that the shift in the landing position is small. In view of the above, in the present embodiment, a test pattern is formed as explained below, and the ink ejection timing is adjusted.

Making the Test Pattern

<Regarding the Process for Determining Adjustment Values>

Figure 15:
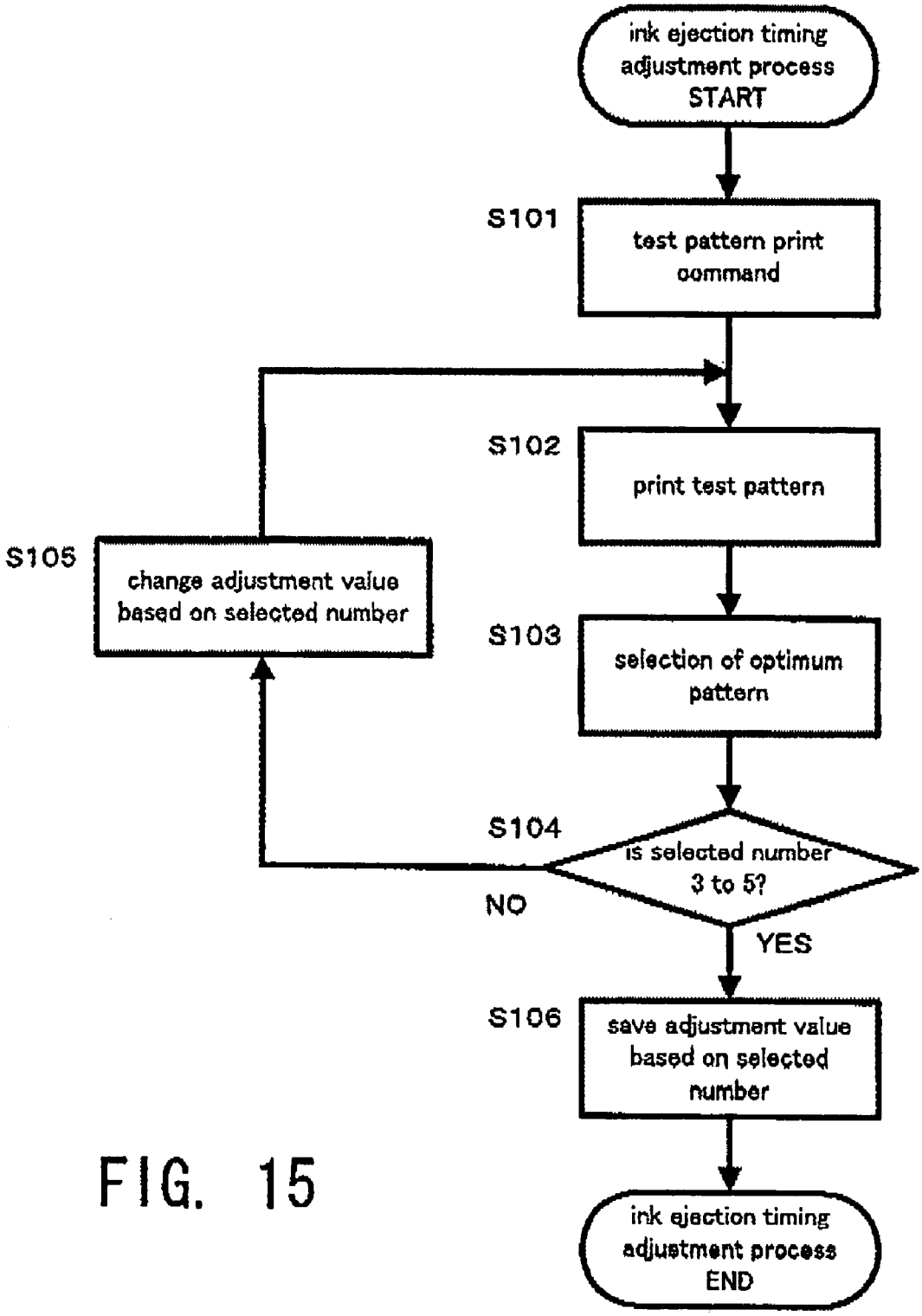
FIG. 15 is a flowchart for the purpose of explaining the process of determining an adjustment value.

FIG. 15 is a flowchart for the purpose of explaining the process of determining an adjustment value Various operations of the printer that are explained below are realized by a program stored in the memory 63 in the printer. The program is constructed of codes for performing various operations that are explained below.

Figure 16:
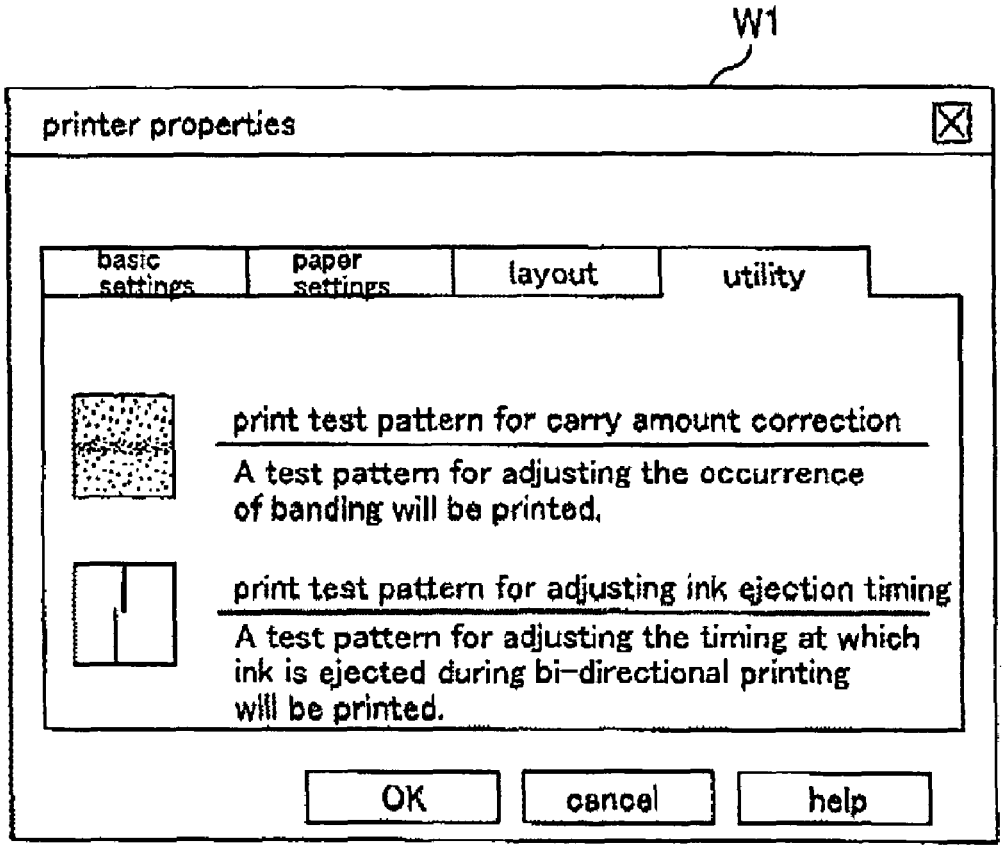
FIG. 16 is an explanatory diagram of a user interface for giving instructions to print a test pattern.

First, the printer receives a command signal that commands the printer to print the test pattern (S101). The command signal can be received from the computer, or it can be input from a button provided on the body of the printer. If the command to print the test pattern comes from the computer, a user interface such as shown in FIG. 16 is displayed on the display device connected to the computer. A button for commanding the printer to print the test pattern for adjusting the ink ejection timing is displayed in a window W1 that is displayed on the display device. A signal that commands the test pattern to be printed is transmitted from the computer to the printer 1 when the user clicks this button.

Next, the printer prints the test pattern (S102). The printer that received the command signal retrieves information relating to test patterns for adjustment of ink ejection timing from among the test patterns within the memory 63. Then, the printer prints the test pattern onto paper according to the information relating to the test patterns. It should be noted that the method for printing the test pattern for adjusting the ink ejection timing is described later.

Figure 17:
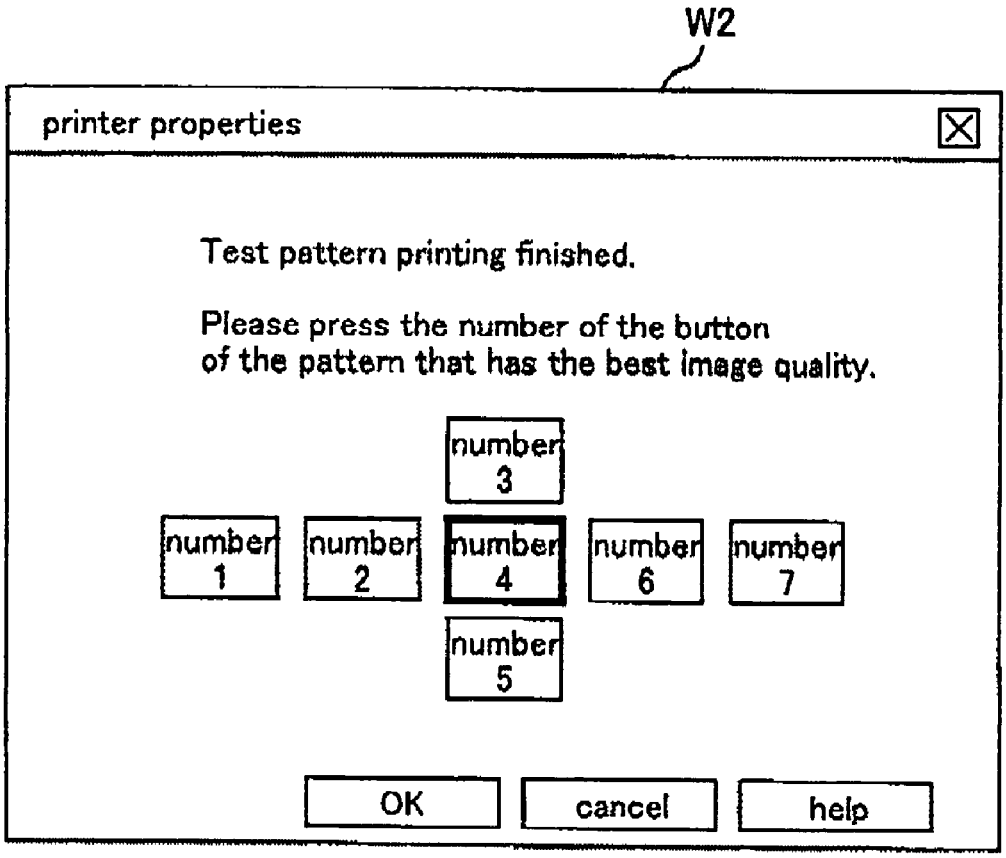
FIG. 17 is an explanatory diagram of a user interface for selecting an optimum pattern.

After printing the test pattern, the user selects the optimum adjustment pattern from among the plurality of adjustment patterns that were printed as test patterns (S103). The optimum pattern can be selected on the computer side, or it can be selected on the printer side. If the optimum pattern is selected on the computer side, then the user interface such as that shown in FIG. 17 is displayed on the display device that is connected to the computer. A window W2 that is displayed on the display device displays a plurality of buttons corresponding to the plurality of adjustment patterns that were printed. By the user clicking on one of these buttons, the adjustment pattern that corresponds to the button that was clicked is selected as the optimum pattern. It should be noted that the plurality of buttons that are displayed on the display device are in the same arrangement as the plurality of the adjustment patterns of the test pattern (the arrangement of the adjustment pattern is described later).

If the number (selected number) of the optimum pattern that was selected is other than 3 to 5 (S104: NO), then the test pattern is printed again. However, before printing the test pattern again, the adjustment value is changed (S105) and settings are made such that the optimum pattern that was selected is formed in the center position (the position in which No=4) of the next test pattern.

If the selected number is 3 to 5 (S104: YES), then the adjustment value that corresponds to the selected number is stored (saved) in the printer (S106). If selection of the optimum pattern was made in the computer, then the adjustment value that corresponds to the selected number is transmitted from the computer to the printer. And, the printer stores the received adjustment value in the memory 63 of the printer.

It should be noted that if the image is to be printed on paper, the printer reads out the adjustment value that is saved in the memory 63 and adjusts the ink ejection timing of the nozzles (the head) based on that adjustment value. As a result, the landing position of the ink is adjusted and image quality can be improved.

<Regarding the Method for Printing the Test Pattern>

Figure 18:
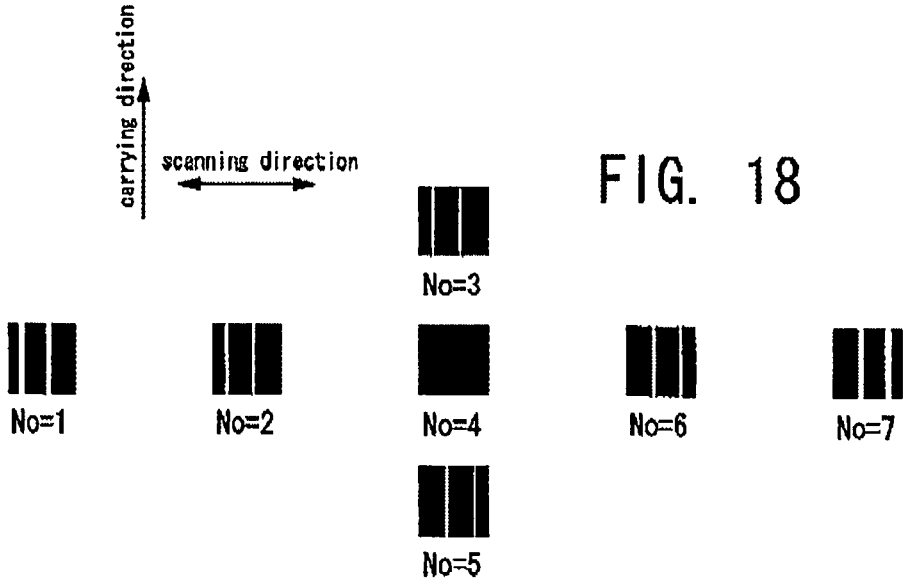
FIG. 18 is an explanatory diagram of a test pattern of the present embodiment.

FIG. 18 is an explanatory diagram of a test pattern of the present embodiment.

The test pattern has a plurality of adjustment patterns. The test pattern contains five adjustment patterns (adjustment patterns No=1, 2, 4, 6 and 7) that are arranged in the scanning direction. Furthermore, an adjustment pattern (adjustment patterns No=3 and 5) is arranged on each of the upstream side and the downstream side, in the carrying direction, of the central adjustment pattern (adjustment pattern No=4) among the five adjustment patterns. It should be noted that, the interval between the adjustment patterns arranged in the scanning direction is wider than the interval between the adjustment patterns arranged in the carrying direction.

Figure 19A:
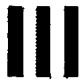
FIG. 19A is an explanatory diagram of a forward pass pattern.
Figure 19B:
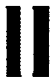
FIG. 19B is an explanatory diagram of a return pass pattern.
Figure 19C:
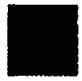
FIG. 19C is an explanatory diagram of an optimum pattern.
Figure 19D:
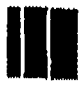
FIG. 19D is an explanatory diagram of an adjustment pattern in which the return pass pattern is shifted to the right with respect to the forward pass pattern.
Figure 19E:
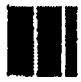
FIG. 19E is an explanatory diagram of an adjustment pattern in which the return pass pattern is shifted to the left with respect to the forward pass pattern.

FIG. 19A is an explanatory diagram of a forward pass pattern. FIG. 19B is an explanatory diagram of a return pass pattern. FIG. 19C is an explanatory diagram of an optimum pattern. FIG. 19D is an explanatory diagram of an adjustment pattern in which the return pass pattern is shifted to the right with respect to the forward pass pattern. FIG. 19E is an explanatory diagram of an adjustment pattern in which the return pass pattern is shifted to the left with respect to the forward pass pattern.

Each adjustment pattern of the test pattern is formed by overlapping the forward pass pattern and the return pass pattern. The forward pass pattern is the pattern that is formed when the carriage moves in the forward pass direction. The return pass pattern is the pattern that is formed when the carriage moves in the return pass direction. The forward pass pattern has three rectangular shaped patterns that are oblong in the carrying direction, and has two blank spaces. The return pass pattern has two rectangular shaped patterns that are oblong in the carrying direction. If the return pass pattern is formed at an ink ejection timing that is appropriate with respect to the forward pass pattern, then the return pass pattern is formed in the blank spaces of the forward pass pattern, and a square-shaped pattern which is completely filled in can be obtained. Conversely, if the return pass pattern is formed at an ink ejection timing that is deviated with respect to the forward pass pattern, then the blank space portions of the forward pass pattern cannot be completely filled, and two white lines are formed in the adjustment pattern.

The relationship between the positions of the forward pass pattern and the reverse pass pattern differ depending on each adjustment pattern For example, when the adjustment pattern No=4 is taken as a reference, the position of the reverse pass pattern with respect to the forward pass pattern of each adjustment pattern is as given below. The return pass pattern of the adjustment pattern No=1 is formed $2/720$ inch to the right of the forward pass pattern (i.e., the timing of the ink ejection 15 when the carriage is moving in the return pass is $2/720$ inch faster than the default timing). The return pass pattern of the adjustment pattern No=2 is formed $1/720$ inch to the right of the forward pass pattern. The return pass pattern of the adjustment pattern No=3 is formed $1/1440$ inch to the right of the forward pass pattern. The return pass pattern of the adjustment pattern No=5 is formed $1/1440$ inch to the left of the forward pass pattern. The return pass pattern of the adjustment pattern No=6 is formed $1/720$ inch to the left of the forward pass pattern. The return pass pattern of the adjustment pattern No=7 is formed $2/720$ inch to the left of the forward pass pattern.

Accordingly, there are differences in the adjustment values that correspond to each adjustment pattern. If the adjustment value that corresponds to the adjustment pattern No=4 is assumed to be zero, then the adjustment value that corresponds to the adjustment pattern No=1 is $-2/720$ inch, the adjustment value that corresponds to the adjustment pattern No=2 is $-1/720$ inch, the adjustment value that corresponds to the adjustment pattern No=3 is $-1/1440$ inch, the adjustment value that corresponds to the adjustment pattern No=5 is $1/1440$ inch, the adjustment value that corresponds to the adjustment pattern No=6 is $1/720$ inch and the adjustment value that corresponds to the adjustment pattern No=7 is $2/720$ inch.

That is, in the present embodiment, the adjustment values of the five adjustment patterns that are arranged in the scanning direction each differ by $1/720$ inch. On the other hand, the adjustment values of the three adjustment patterns that are arranged in the carrying direction each differ by $1/1440$ inch.

The optimum pattern is an adjustment pattern in which there are no white lines, or is an adjustment pattern in which the width of the white lines is the thinnest. The timing of the ink ejection is adjusted according to the adjustment value that corresponds to the optimum pattern.

Supposing that the adjustment pattern No=5 is selected as the optimum pattern (YES at S104), then the adjustment value of the ink ejection timing becomes $1/1440$ inch. In this case, the ink ejection timing when the carriage is moving in the return pass is corrected to a timing that is delayed by $1/1440$ inch than the default timing. As a result, the ink landing position in the return pass is shifted by $1/1440$ inch to the left side of the default ink landing position.

Furthermore, supposing that the adjustment pattern No=2 is selected as the optimum pattern (NO at S104), then the adjustment value of the ink ejection timing is changed from the default value (zero) to $-1/720$ inch. Then, the test pattern is formed again based on the adjustment value that was changed. In the test pattern that is formed again, the adjustment value that corresponds to the adjustment pattern No=4 becomes $-1/720$ inch. It should be noted that the adjustment value that corresponds to the adjustment pattern No=2 becomes $-2/720$ inch and the adjustment value that corresponds to the adjustment pattern No=3 becomes $-3/1440$ inch ($-1/720$ inch $-1/1440$ inch).

<Regarding the Position where the Adjustment Pattern is Formed>

Figure 20:
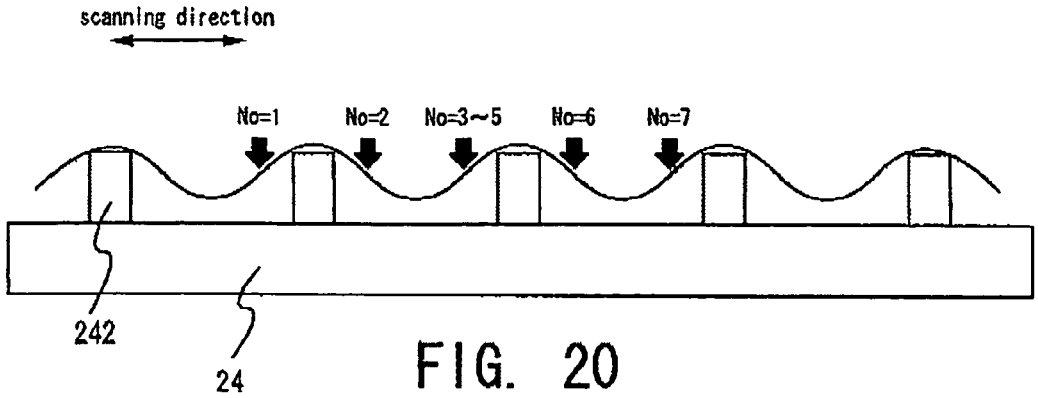
FIG. 20 is an explanatory diagram of the forming positions of the adjustment patterns.

FIG. 20 is an explanatory diagram showing the positions where each adjustment pattern of the test pattern of this embodiment is formed. The diagram shows a view from the carrying direction. In this diagram, structural elements that have already been described are assigned identical reference numerals and further description thereof has been omitted. As already described, the paper is supported by the protrusions 242 and is wave-shaped (corrugated) when viewed from the carrying direction. Furthermore, the portions of the wave that are elevated (the peak portions, or the convex portions) are the portions that are supported by the protrusions 242. Conversely, the portions of the wave that are lower (the trough portions, or the concave portions) are the portions that are positioned between the protrusions 242.

The black arrows in the figure show the positions at which the adjustment patterns are formed. In the present embodiment, the adjustment patterns are formed in positions that are between the central position between two protrusions 242, and the position of each of those protrusions 242. That is, the adjustment patterns are formed so that they are located at positions halfway between the peak portions and the trough portions of the wave-shaped paper. The positions of the peak portions and the trough portions depend on the positions of the protrusions 242, which are already known, and therefore, the position halfway between the peak portions and the trough portions can be determined from the positions of the protrusions 242.

If the adjustment patterns are formed at the positions of the black arrows in the diagram, the distances between the head and the paper (i.e., the "gaps") at the positions where the adjustment patterns are formed are substantially the same. Thus, the positional relationship of the return pass pattern with respect to the forward pass pattern of each adjustment pattern will change according to the numerical sequence of the adjustment patterns.

Figure 21:
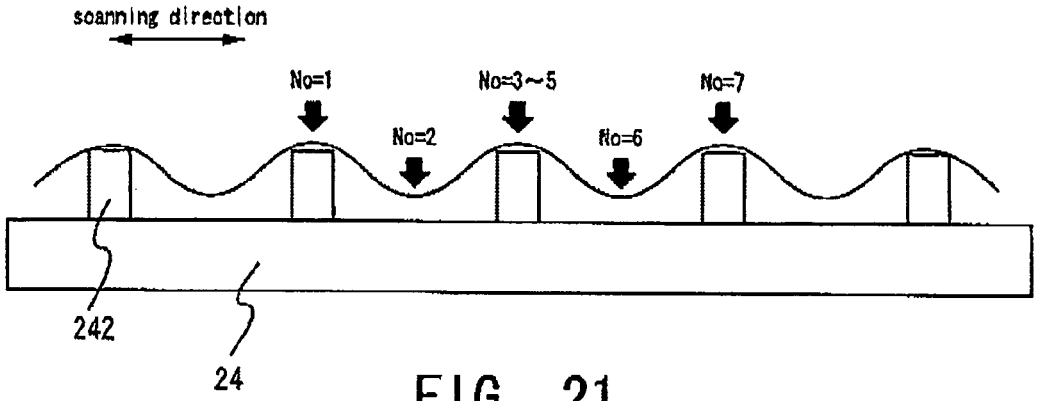
FIG. 21 is an explanatory diagram showing the positions where adjustment patterns are formed in a test pattern of a reference example.

FIG. 21 is an explanatory diagram of forming positions of adjustment patterns of a test pattern according to a reference example. In the reference example, the adjustment patterns are formed on the peak portions and on the trough portions of the undulating paper. Because of this, the gap at the position where each adjustment pattern is formed differs. As a result, the positional relationship of the return pass pattern with respect to the forward pass pattern of each adjustment pattern in the test pattern of the reference example does not change in the numerical sequence of the adjustment patterns. Furthermore, there is the possibility that there are two optimum patterns in the test pattern of the reference example. Consequently, a correct adjustment value for the ink ejection timing cannot be obtained with the test pattern of the reference example.

Figure 22:
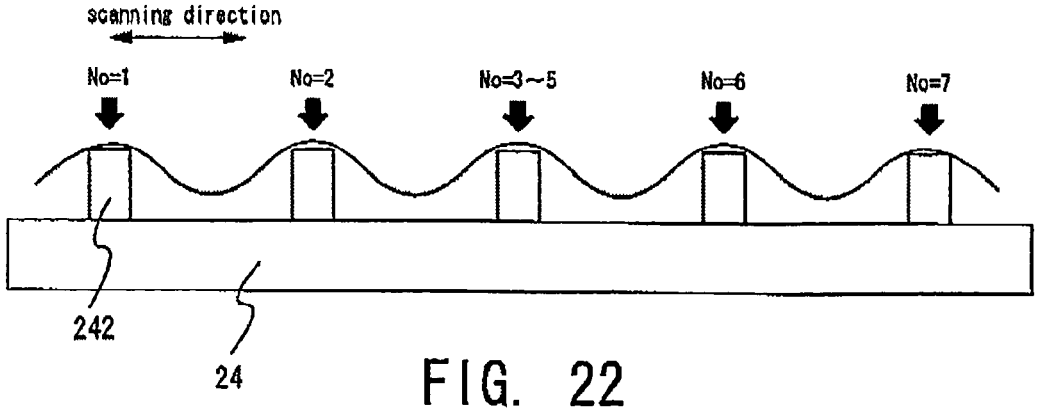
FIG. 22 is an explanatory diagram showing the positions where adjustment patterns are formed in a test pattern of another reference example.

FIG. 22 is an explanatory diagram of forming positions of adjustment patterns of a test pattern according to another reference example. In this reference example, the adjustment patterns are only formed on the peak portions of the undulating paper. In this case, the gaps at the positions where each adjustment pattern is formed are substantially the same. Thus the test pattern can be correctly printed.

However, in this reference example, when printing is performed in accordance with the adjustment value that has been determined using this test pattern, the quality of the image that is formed on the peak portions is excellent, but the quality of the image formed on the trough portions becomes very poor. This is because when the adjustment value is determined by producing the adjustment patterns only on the peak portions, there is a large difference between the gap at the trough portions and the gap at the peak portions, such that there is a large shift in the landing position of the dots at the trough portions.

Furthermore, in this reference example, because low-quality image portions are printed at the periodic cycle of the trough portions, the periodic cycle according to which the low-quality image portions appear becomes large. If the periodic cycle according to which the low-quality image portions appear is large, then the deterioration of image quality becomes noticeable, and the image quality of the entire image is deteriorated.

On the other hand, in the present embodiment, the adjustment patterns are formed such that they are located at positions halfway between the peak portions and the trough portions of the wavy paper. Thus, the difference between the gap at the halfway position and the gap at the peak portion (or the trough portion) is small. Thus there is not a large shift in the landing position of the dots, and deterioration of the image quality can be suppressed.

Furthermore, in the present embodiment, because the low-quality image portions appear at the peak portions and the trough portions, the periodic cycle of appearance becomes short (which is half the cycle of the reference example previously described). When the appearance cycle of the low-quality image portions is short, then the deterioration of the image quality is less noticeable, and deterioration of the image quality of the entire image can be suppressed.

OTHER EMBODIMENTS

The foregoing embodiment described primarily a printer. However, it goes without saying that the foregoing description also includes the disclosure of printing apparatuses, recording apparatuses, liquid ejecting apparatuses, printing methods, recording methods, liquid ejecting methods, printing systems, recording systems, computer systems, programs, storage media having programs recorded thereon, display screens, screen display methods, and methods for producing printed matter, for example.

Further, a printer, for example, was described above as an embodiment. However, the foregoing embodiment is for the purpose of elucidating the present invention and is not to be construed as limiting the present invention. The invention can of course be altered and improved without departing from the gist thereof and includes its equivalents. In particular, the implementations mentioned below are also included in the invention.

<Regarding the Printer>

In the above embodiment, a printer was described. This, however, is not a limitation. It is possible to apply a similar technique as in the present embodiment to a variety of recording apparatuses that utilize inkjet technology such as color filter manufacturing apparatuses, dying apparatuses, fine processing apparatuses, semiconductor manufacturing apparatuses, surface processing apparatuses, three-dimensional molding machines, fluid gasification apparatuses, organic EL manufacturing apparatuses (particularly macromolecular EL manufacturing apparatuses), display manufacturing apparatuses, film forming apparatuses, and DNA chip manufacturing apparatuses. Furthermore, methods for these apparatuses and manufacturing methods are also within the scope of application. If the present technique is utilized in fields such as these, it is possible to achieve a reduction in materials, processes, and costs compared to conventional printing techniques because the present technique is characterized by directly ejecting (rendering) a liquid toward a target object.

<Regarding the Ink>

Since the foregoing embodiment was an embodiment of a printer, a dye ink or a pigment ink was ejected from the nozzles. However, the liquid that is ejected from the nozzles is not limited to such inks. For example, it is also possible to eject, from the nozzles, a liquid (including water) including metallic materials, organic materials (particularly macromolecular materials), magnetic materials, conductive materials, wiring materials, film-formation materials, electronic ink, processing liquid or genetic solutions. A reduction in materials, processes, and costs can be achieved if such liquids are directly ejected toward a target object.

<Regarding the Nozzles>

In the foregoing embodiment, ink was ejected using piezoelectric elements. However, the method for ejecting liquid is not limited to this. Other methods may also be employed, such as a method for generating bubbles in the nozzles through heat.

<Summary>

Figure 11B:
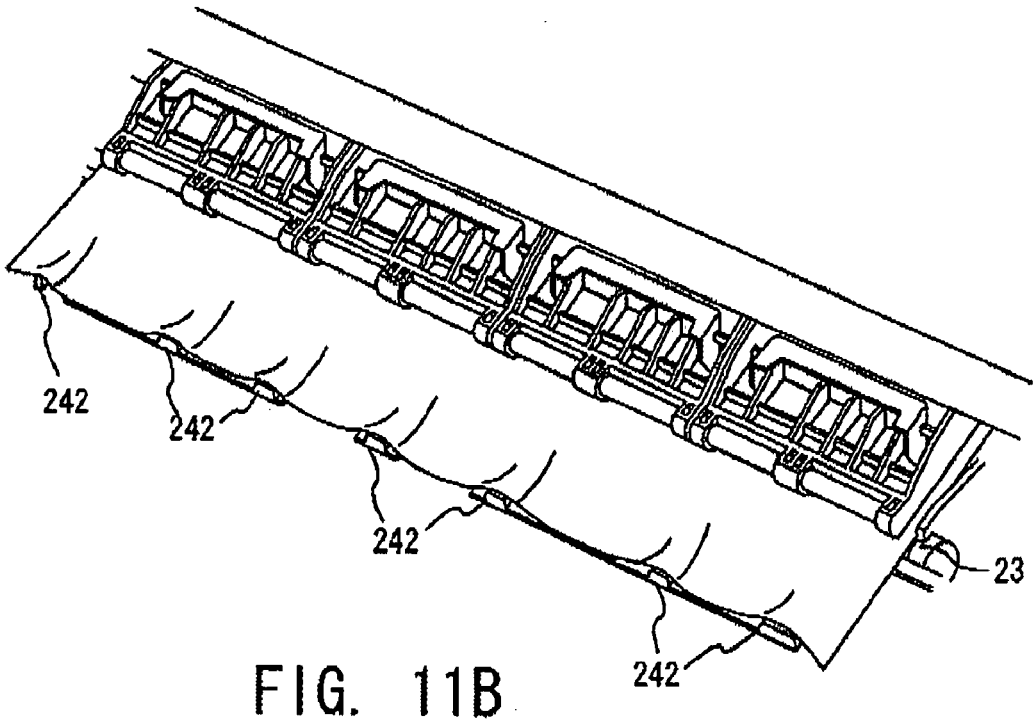
FIG. 11B is a perspective view of paper that is carried by carry rollers.

(1) In the foregoing embodiment, the printer (liquid ejecting apparatus, printing apparatus) is provided with a carriage (moving member) that moves nozzles (liquid ejection sections that eject liquid) in the scanning direction (movement direction), and a plurality of protrusions 242 (supporting sections) that are arranged at different positions in the scanning direction. Since the paper is supported by the protrusions 242, even if the printer performs "borderless printing", this can be carried out without soiling the back side of the paper with ink that did not land on the paper. However, in such a configuration, the paper that is supported by the protrusions becomes wave-shaped as shown in FIG. 11B.

In such a condition, when a plurality of adjustment patterns are lined up in the scanning direction, the form of each adjustment pattern is affected by deformation of the paper (i.e., affected by the distance between the head and the paper). Thus, supposing that a group of adjustment patterns for fine adjustment are lined up in the scanning direction, the shape of each pattern will not change in sequence, and problems such as the appearance of two optimum patterns may arise.

On the other hand, if all the adjustment patterns are lined up in the carrying direction, then the adjustment patterns are not affected by paper deformations, but not only do the patterns take time to form, it is not possible to arrange many patterns on the paper with good efficiency.

In view of the above, in the foregoing embodiment, the adjustment patterns No=1, 2, 4, 6 and 7, which are formed in the scanning direction (the movement direction), constitute the group of patterns for coarse adjustment, and the adjustment patterns No=3 to 5, which are formed in the carrying direction (the direction intersecting with the movement direction), constitute the group of patterns for fine adjustment. It should be noted that the group of patterns for coarse adjustment is the group of patterns for performing adjustment of 1/720 inch, and the group of patterns for fine adjustment is the group of patterns for performing adjustment of 1/1440 inch.

In the foregoing embodiment, since the group of patterns for coarse adjustment is lined up in the scanning direction, the shapes of the patterns change in sequence, even if they are affected by deformations of the paper. On the other hand, since the group of patterns for fine adjustment is lined up in the carrying direction, the shapes of the patterns change in sequence without the patterns being affected by paper deformations.

Consequently, according to the foregoing embodiment, a plurality of patterns can be formed on paper that is deformed, such that the shapes of the patterns change in sequence. Accordingly, an adjustment value can be obtained for the purpose of causing ink to land with high accuracy, even from adjustment patterns that are formed on deformed paper.

Figure 23:
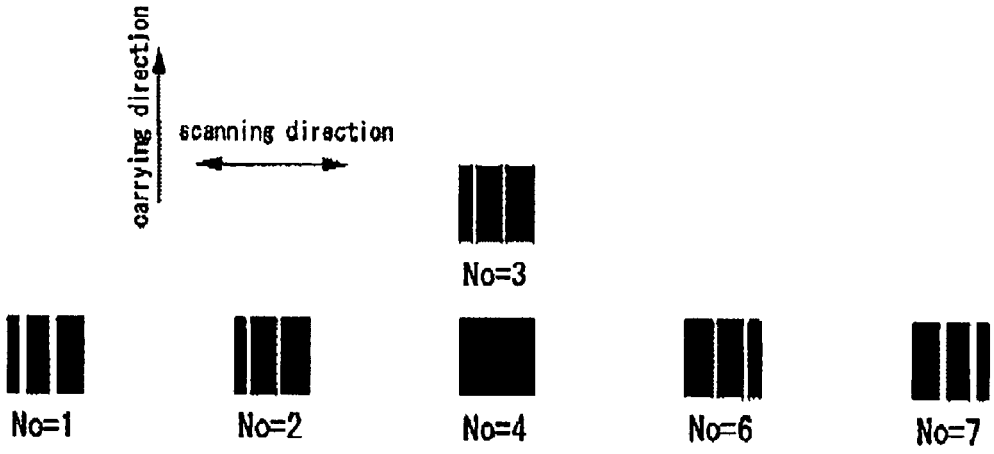
FIG. 23 is an explanatory diagram of an arrangement of adjustment patterns in another embodiment.
Figure 24:
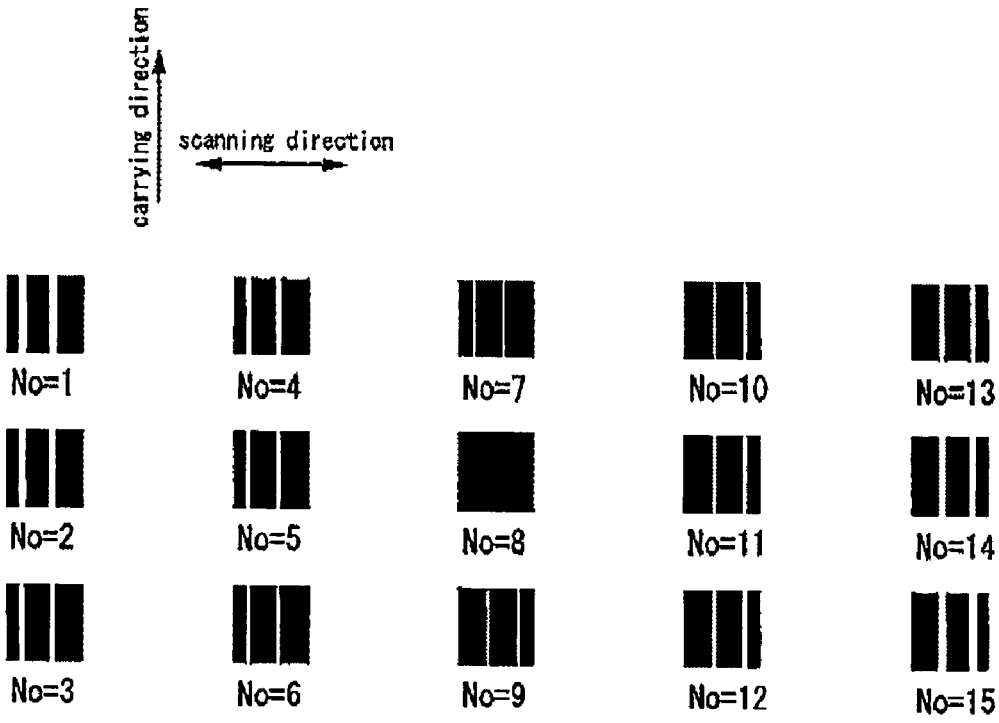
FIG. 24 is an explanatory diagram of an arrangement of adjustments patterns in another embodiment.

However, the arrangement of the plurality of patterns is not limited to the arrangement in the foregoing embodiment. As shown in FIG. 23 for example, the number of pattern groups for fine adjustment (the number of adjustment patterns that are lined up in the carrying direction) can be set to two. Furthermore, as shown in FIG. 24 for example, it is also possible to arrange an adjustment pattern for fine adjustment on the upstream side and the downstream side, in the carrying direction, of all of the adjustment patterns for coarse adjustment.

(2) In the foregoing embodiment, the plurality of adjustment patterns each correspond to a specific adjustment value. In the group of patterns for coarse adjustment, the adjustment value that corresponds to each adjustment pattern changes in a stepwise manner by 1/720 inch each. In the group of patterns for fine adjustment, the adjustment value that corresponds to each adjustment pattern changes in a stepwise manner by 1/1440 inch each. That is, in the foregoing embodiment, the difference in adjustment value between the adjustment patterns in the pattern group for coarse adjustment (1/720 inch) is twice the difference in adjustment value between the adjustment patterns in the pattern group for fine adjustment (1/1440 inch).

Accordingly, in the foregoing embodiment, since the adjustment value of the group of adjustment patterns No=2 to 6 changes by 1/1440 inch each, the number of patterns for fine adjustment can be substantially increased.

(3) In the foregoing embodiment, there is an adjustment pattern that is included in the group of patterns for coarse adjustment and in the group of patterns for fine adjustment. More specifically, the adjustment pattern No=4 belongs to the group of patterns for coarse adjustment and also the group of patterns for fine adjustment.

In this way, the plurality of adjustment patterns can be arranged efficiently.

(4) In the foregoing embodiment, the group of patterns for coarse adjustment contains more patterns than the group of patterns for fine adjustment. More specifically, in the foregoing embodiment, there are five adjustment patterns for coarse adjustment, and there are three adjustment patterns for fine adjustment.

Since the group of patterns for coarse adjustment is arranged in the scanning direction, even it the number of patterns in the group of patterns for coarse adjustment is increased, there is no change in the moving operation of the carriage, and there is no increase in printing time. However, since the group of patterns for fine adjustment is arranged in the carrying direction, if the number of patterns in the group of patterns for fine adjustment is increased, then the moving operation of the carriage and the carrying operation of the carry roller increase, and thus there is an increase in printing time.

Therefore, printing time can be shortened according to the foregoing embodiment.

(5) In the foregoing embodiment, adjustment patterns are formed at positions that depend of the positions of the protrusions 242 (supporting sections) in the scanning direction (the movement direction).

In this way, since the adjustment patterns are formed at positions in which consideration is given to deformation of the paper, it is possible to obtain an adjustment value for the purpose of causing ink to land with high accuracy, even from adjustment patterns that are formed on deformed paper.

(6) In the foregoing embodiment, the printer (liquid ejecting apparatus, printing apparatus) is provided with a carriage (moving member) that moves nozzles (liquid ejection sections that eject liquid) in the scanning direction (movement direction), and a plurality of protrusions 242 (supporting sections) that are arranged at different positions in the scanning direction. Since the paper is supported by the protrusions 242, even if the printer performs "borderless printing", this can be carried out without soiling the back side of the paper with ink that did not land on the paper. However, in such a configuration, the paper that is supported by the protrusions becomes wave-shaped. Due to this, the shift in the ink landing position differs depending on its position in the scanning direction.

In such a configuration, when the adjustment patterns (patterns for the purpose of adjusting the liquid ejection timing) are formed by ejecting the ink (liquid) from the nozzles (liquid ejection sections) onto the paper (medium), which is supported by the protrusions (supporting sections), there is a possibility that the optimum pattern may not be correctly selected.

In view of the above, in the foregoing printer, the adjustment patterns are formed in positions that depend on the positions of the protrusions 242 (supporting sections) in the scanning direction (movement direction).

In this way, since the adjustment patterns are formed at positions that take into consideration the deformation of the paper, it is possible to obtain an adjustment value for the purpose of causing ink to land with high accuracy, even from adjustment patterns that are formed on deformed paper.

(7) In the foregoing embodiment, five adjustment patterns are formed in the scanning direction (movement direction). In conventional cases, adjustment patterns cannot be formed accurately even if a plurality of adjustment patterns are formed in the scanning direction on wave-shaped paper, and therefore, it is not possible to compare the plurality of adjustment patterns in sequence. However, according to the foregoing embodiment, since the patterns are formed depending on the position of the protrusions 242 in the scanning direction, the plurality of adjustment patterns can be compared in sequence.

(8) In the foregoing embodiment, three adjustment patterns are formed in the carrying direction of the paper (medium). Since the convex and concave portions of the paper supported by the protrusions 242 extend along the carrying direction, the adjustment patterns can be formed at substantially the same conditions if the patterns are formed in the carrying direction. As a result, since the adjustment pattern can be formed correctly, the plurality of adjustment patterns can be compared in sequence.

(9) In the foregoing embodiment, the adjustment patterns No=1, 2, 4, 6 and 7 that were formed in the scanning direction (movement direction) constituted the group of patterns for coarse adjustment, and the adjustment patterns No=3 to 5 that were formed in the carrying direction (the direction intersecting the movement direction) constituted the group of patterns for fine adjustment. The group of coarse adjustment patterns is for adjustment by $1/720$ inch, and the group of fine adjustment patterns is for adjustment by $1/1440$ inch.

As already explained, in the foregoing embodiment, the patterns that are arranged in the scanning direction and the patterns that are arranged in the carrying direction are formed under substantially the same conditions (particularly, with the same gap). However, when the shape of the paper is considered, the forming conditions of the patterns arranged in the carrying direction are more stable than the forming conditions of the patterns arranged in the scanning direction. Because of this, the group of patterns for coarse adjustment is arranged in the scanning direction, and the group of patterns for fine adjustment is arranged in the carrying direction.

Thus, the adjustment patterns for the purpose of carrying out coarse adjustment, and the adjustment patterns for the purpose of carrying out fine adjustment can be arranged with excellent efficiency.

(10) In the foregoing embodiment, each of the plurality of adjustment patterns corresponds to a specific adjustment value, and the difference between adjustment values of adjustment patterns that are arranged in the scanning direction (movement direction) is larger than the difference between adjustment values of the adjustment patterns that are arranged in the carrying direction.

As already described above, in the foregoing embodiment, the patterns lined up in the scanning direction and the patterns lined up in the carrying direction are formed under substantially the same conditions (particularly the gap). However, when the shape of the paper is taken into consideration, the forming conditions of the patterns that are lined up in the carrying direction are more stable than the forming conditions of the patterns that are lined up in the scanning direction. Because of this, it is preferable that the adjustment patterns for carrying out coarse adjustment are arranged in the scanning direction, and the adjustment patterns for carrying out fine adjustment are arranged in the carrying direction.

Accordingly, in the foregoing embodiment, the difference between the adjustment values of the adjustment patterns No=1, 2, 4, 6 and 7 that are lined up in the scanning direction is $1/720$ inch. This difference is used for carrying out coarse adjustment. On the other hand, the difference between the adjustment values of the adjustment patterns No=3 to 5 that are lined up in the carrying direction is $1/1440$ inch, and this difference is used for performing fine adjustment.

Thus, the adjustment patterns for the purpose of coarse adjustment and the adjustment patterns for the purpose of fine adjustment can be efficiently arranged.

(11) In the foregoing embodiment, when the paper (medium) is carried, the leading edge of the paper contacts the protrusions (supporting sections). Since a plurality of protrusions are arranged in the movement direction, the leading edge of the paper that has come into contact with the protrusions becomes wave-shaped. When the leading edge of the paper becomes wave shaped, the paper strength increases and the paper can be carried without warping.

(12) In the foregoing embodiment, the plurality of protrusions 242 (supporting sections) are provided on the platen 24, and the paper (medium) is carried from above in an obliquely downward direction toward the platen. Thus, the paper is carried such that its leading edge contacts the protrusions 242. Furthermore, since the curl of the paper disappears after the paper contacts the protrusions, the leading edge of the paper does not rise up from the platen, and thus it is possible to prevent the leading edge of the paper from rubbing against the head. Furthermore, since the paper is carried obliquely to contact the protrusions, the paper contacts the protrusions firmly, and the amount of deformation of the paper becomes substantially the same each time.

It should be noted that it is also possible to not carry the paper obliquely with respect to the platen. Even in this way, a plurality of patterns can be formed on the deformed paper, such that the shape of the patterns changes in sequence. Furthermore, even if the paper is not carried obliquely with respect to the platen, since the adjustment patterns are formed in positions in consideration of the deformations of the paper, the optimum pattern can be correctly selected. However, in this case, the effect described above cannot be obtained.

(13) In the foregoing embodiment, the gap (distance) between the paper (medium) and the nozzles (liquid ejection sections) differs depending on the position in the scanning direction (movement direction). In such a case, since the flying distance of the ink droplets differs, the shift in the landing position of the ink becomes different depending on its position in the scanning direction. However, since the patterns are formed in accordance with the positions of the protrusions 242 in the scanning direction, it is possible to reduce such an influence.

(14) In the foregoing embodiment, five adjustment patterns are formed in the scanning direction (movement direction). In conventional cases, since adjustment patterns cannot be formed accurately even if a plurality of adjustment patterns are formed in the scanning direction on wave-shaped paper, it is not possible to compare the plurality of adjustment patterns in sequence. However, in the foregoing embodiment, since the patterns are formed in accordance with the position of the protrusions 242 in the scanning direction, the plurality of adjustment patterns can be compared in sequence.

(15) In the foregoing embodiment, the adjustment patterns (the patterns) are formed at a position halfway between the peak portion and the trough portion of the paper (i.e., between the concave portion and the convex portion of the medium) when the adjustment patterns are formed in such positions, the following effects can be obtained.

First, there is no large shift in the landing position of the dots. If the ink ejection timing is adjusted by forming the adjustment patterns on the peak portions of the paper, then there would be a big shift in the landing position of the dots in the trough portions of the paper. On the other hand, if the adjustment patterns are formed at the halfway positions, then the difference between the gap (i.e., the distance between the nozzle and the paper) at the peak portion and the gap at the halfway position is small, and therefore, the shift in landing position of the dots is small.

Second, the drop in image quality becomes less noticeable. If the ink ejection timing is adjusted by forming the adjustment patterns on the peak portions of the paper, then the image quality in the trough portions of the paper will drop, the low-quality image portions will appear at large periodic cycles, and the drop in image quality will become noticeable. On the other hand, if the adjustment patterns are formed at the halfway positions, then since the low-quality image portions appear on the peak portions and the trough portions, the cycle of appearance of the low-quality image portions becomes shorter, and the drop in image quality is not as noticeable.

Due to these two effects, excellent images can be formed on the paper.

However, the forming positions of the adjustment patterns are not limited to this. For example, it is also possible to form the adjustment patterns on the peak portions (or the trough portions) of the paper, although the two effects described above become unobtainable. Even in cases such as this, a plurality of patterns can be formed on the deformed paper such that the shape of the patterns changes in sequence. Furthermore, even in such a case, since the adjustment patterns can be formed at positions at which the gaps (i.e., the distances between the paper and the nozzle) are substantially the same, the adjustment patterns can be compared in sequence.

(16) In the foregoing embodiment, the adjustment patterns are formed between a central positions between two protrusions 242, and the position of each of those protrusions 242. Thus, the adjustment patterns are formed at positions halfway between the peak portions and the trough portions of the paper. When the adjustment patterns are formed in such positions, the following effects can be obtained.

First, there is no large shift in the landing position of the dots. If the ink ejection timing is adjusted by forming the adjustment patterns on the peak portions of the paper, then there would be a big shift in the landing position of the dots in the trough portions of the paper. On the other hand, if the adjustment patterns are formed at the halfway positions, then the difference between the gap (i.e., the distance between the nozzle and the paper) at the peak portion and the gap at the halfway position is small, and therefore, the shift in landing position of the dots is small.

Second, the drop in image quality becomes less noticeable. If the ink ejection timing is adjusted by forming the adjustment patterns on the peak portions of the paper, then the image quality in the trough portions of the paper will drop, the low-quality image portions will appear at large periodic cycles, and the drop in image quality will become noticeable. On the other hand, if the adjustment patterns are formed at the halfway positions, then since the low-quality image portions appear on the peak portions and the trough portions, the cycle of appearance of the low-quality image portions becomes shorter, and the drop in image quality is not as noticeable.

Due to these two effects, excellent images can be formed on the paper.

However, the forming positions of the adjustment patterns are not limited to this. For example, it is also possible to form the adjustment patterns at the central position between the two protrusions (or at the positions of the protrusions), although the two effects described above become unobtainable. Even in such a case, a plurality of patterns can be formed on the deformed paper such that the shape of the patterns changes in sequence. Furthermore, even in such a case, since the adjustment patterns can be formed at positions at which the gaps (i.e., the distances between the paper and the nozzle) are substantially the same, the adjustment patterns can be compared in sequence.

(17) In the foregoing embodiment, the gap (distance) between the paper (medium) and the nozzles (liquid ejection sections) differs depending on the position in the scanning direction (movement direction). In this case, since the flying distance of the ink droplets differs, the shift in the landing position of the ink becomes different depending on its position in the scanning direction. However, since the patterns are formed in accordance with the positions of the protrusions 242 in the scanning direction, it is possible to reduce such an influence.

(18) In the foregoing embodiment, two white lines are formed in the adjustment patterns.

In the position in which the adjustment patterns are formed, the paper is inclined. Thus, a difference in the gap exists even within each adjustment pattern. The reason that a plurality of lines are formed in each adjustment pattern is for averaging the influence caused by the difference in the gap within a single adjustment pattern. Accordingly, it is possible to correctly select the optimum pattern.

It should be noted that the adjustment pattern is not limited to that of the foregoing embodiment. For example, the adjustment pattern can be constructed of a vertical line that is formed during the forward pass, and a vertical line that is formed during the return pass. In this case, the adjustment pattern in which the two vertical lines become a single straight line is selected as the optimum patterns However, this type of adjustment pattern does not achieve the averaging effect described above.

(19) In the foregoing embodiment, the carriage (moving member) is capable of moving in both directions, and the nozzles (liquid ejection sections) eject ink (liquid) while the carriage is moving in both directions.

In such a case in which bi-directional printing is performed, it is necessary to adjust the ink ejection timing for the forward pass, and the ink ejection timing for the return pass. However, even if the ink ejection timing is adjusted, if the gap differs from the gap at the time of the adjustment, the landing position of the ink will deviate. In the foregoing embodiment, a large reduction in image quality can be suppressed, even in the above-described case.

However, the problem of shift in the landing position of the ink is not limited to when bi-directional printing is performed. For example, the same problem also occurs, even when printing is performed in a single direction, in instances where adjustment of the ink ejection timing is made for a certain nozzle group (for example, a black ink nozzle group) and adjustment of the ink ejection timing is made for another nozzle group (for example, a cyan ink nozzle group). Consequently, the adjustment pattern of the foregoing embodiment is not just an adjustment pattern for adjusting the ink ejection timing during bi-directional printing, but it can also serve as the adjustment pattern for adjusting the ink ejection timing between other nozzle groups.

What is claimed is:

1. A method for liquid ejection comprising:

moving nozzles, which eject a liquid, in a movement direction;

supporting a medium with a plurality of supporting sections that are arranged at different positions in said movement direction; and forming a plurality of patterns for adjusting a liquid ejection timing by ejecting said liquid from said nozzles onto said medium supported by said supporting sections, each pattern being formed in a position corresponding to a position in the movement direction of the supporting section, and being in a predetermined positional relationship with at least one of a plurality of the supporting sections.

2. A method for liquid ejection according to claim 1, wherein a plurality of the patterns are formed along said movement direction.

3. A method for liquid ejection according to claim 2, wherein a plurality of the patterns are formed along a carrying direction in which said medium is carried.

4. A method for liquid ejection according to claim 3, wherein:

said plurality of patterns formed along said movement direction constitute a group of patterns for coarse adjustment; and said plurality of patterns formed along said carrying direction constitute a group of patterns for fine adjustment.

5. A method for liquid ejection according to claim 3, wherein:

each of said plurality of patterns corresponds to a specific adjustment value; and a difference between the adjustment values of said patterns that are lined up in said movement direction is larger than a difference between the adjustment values of said patterns that are lined up in said carrying direction.

6. A method for liquid ejection according to claim 1, wherein a leading edge of said medium contacts said supporting sections when said medium is carried.

7. A method for liquid ejection according to claim 6, wherein:

said plurality of supporting sections are provided on a platen; and said medium is carried from above in an obliquely downward direction toward said platen.

8. A method for liquid ejection according to claim 1, wherein said medium that is supported by said plurality of supporting sections is deformed such that said medium has a concave portion and a convex portion.

9. A method for liquid ejection according to claim 8, wherein said concave portion or said convex portion of said medium runs in a carrying direction in which said medium is carried.

10. A method for liquid ejection according to claim 8, wherein said pattern is formed between said concave portion and said convex portion of said medium.

11. A method for liquid ejection according to claim 1, wherein said pattern is formed between a central position between two said supporting sections and the position of one of said two supporting sections.

12. A method for liquid ejection according to claim 1, wherein a distance between said medium and said nozzles differs depending on the position in said movement direction.

13. A method for liquid ejection according to claim 1, wherein a plurality of lines are formed in said pattern.

14. A method for liquid ejection according to claim 1, wherein:

said nozzles can be moved in both directions by a moving member; and said nozzles eject said liquid while said moving member is moving in both directions.

15. A method for liquid ejection according to claim 1, wherein said liquid is an ink.

16. A method for liquid ejection comprising the steps of:

moving nozzles, which eject a liquid, in a movement direction;

supporting a medium with a plurality of supporting sections that are arranged at different positions in said movement direction; and forming a plurality of patterns for adjusting a liquid ejection timing by ejecting said liquid from said nozzles onto said medium supported by said supporting sections, each pattern being formed in a position corresponding to a position in the movement direction of the supporting section, and being in a predetermined positional relationship with at least one of a plurality of the supporting sections;

wherein a leading edge of said medium contacts said supporting sections when said medium is carried;

wherein said plurality of supporting sections are provided on a platen;

wherein said medium is carried from above in an obliquely downward direction toward said platen;

wherein said medium that is supported by said plurality of supporting sections is deformed such that said medium has a concave portion and a convex portion;

wherein said concave portion or said convex portion of said medium runs in a carrying direction in which said medium is carried;

wherein said pattern is formed between said concave portion and said convex portion of said medium;

wherein said pattern is formed between a central position between two said supporting sections and the position of one of said two supporting sections;

wherein a distance between said medium and said nozzles differs depending on the position in said movement direction;

wherein a plurality of the patterns are formed along said movement direction;

wherein a plurality of the patterns are formed along said carrying direction in which said medium is carried;

wherein said plurality of patterns formed along said movement direction constitute a group of patterns for coarse adjustment;

wherein said plurality of patterns formed along said carrying direction constitute a group of patterns for fine adjustment;

wherein each of said plurality of patterns corresponds to a specific adjustment value;

wherein a difference between the adjustment values of said patterns that are lined up in said movement direction is larger than a difference between the adjustment values of said patterns that are lined up in said carrying direction;

wherein a plurality of lines are formed in each of said patterns;

wherein said nozzles can be moved in both directions by a moving member;

wherein said nozzles eject said liquid while said moving member is moving in both directions; and wherein said liquid is an ink.

* * * * *